US009947182B2

(12) United States Patent
Takada et al.

(10) Patent No.: US 9,947,182 B2
(45) Date of Patent: Apr. 17, 2018

(54) MEDIUM PROCESSING DEVICE AND MEDIUM TRANSACTION DEVICE

(71) Applicant: Oki Electric Industry Co., Ltd., Tokyo (JP)

(72) Inventors: Atsushi Takada, Tokyo (JP); Kazuhiro Hosokawa, Tokyo (JP); Wataru Wakushima, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 15/327,656

(22) PCT Filed: Jun. 11, 2015

(86) PCT No.: PCT/JP2015/066940
§ 371 (c)(1),
(2) Date: Jan. 19, 2017

(87) PCT Pub. No.: WO2016/013324
PCT Pub. Date: Jan. 28, 2016

(65) Prior Publication Data

US 2017/0206749 A1 Jul. 20, 2017

(30) Foreign Application Priority Data

Jul. 25, 2014 (JP) ..... 2014-151797

(51) Int. Cl.
*G07F 19/00* (2006.01)
*B65H 31/22* (2006.01)
*B65H 31/24* (2006.01)

(52) U.S. Cl.
CPC ..... *G07F 19/205* (2013.01); *B65H 31/22* (2013.01); *B65H 31/24* (2013.01); *B65H 2402/32* (2013.01); *B65H 2701/1912* (2013.01)

(58) Field of Classification Search
CPC ..... G07F 19/205; B65H 31/22; B65H 31/24; B65H 2402/32; B65H 2701/1912
(Continued)

(56) References Cited

U.S. PATENT DOCUMENTS

2004/0178568 A1* 9/2004 Graef ..... B65H 5/025 271/264
2006/0157916 A1* 7/2006 Ahn ..... B65H 1/02 271/145
(Continued)

FOREIGN PATENT DOCUMENTS

JP H09-235061 A 9/1997
JP 2011-118699 A 6/2011
(Continued)

*Primary Examiner* — Karl D Frech
(74) *Attorney, Agent, or Firm* — Rabin & Berdo, P.C.

(57) ABSTRACT

A medium processing device includes a storage cassette, a casing for storing the storage cassette, a loading section that supports the storage cassette, a slide rail attached to the casing and the loading section, and that allows the loading section to move between the interior and the exterior of the internal space, and a connector. The connector is outside of a pass-through region through which the storage cassette passes in a case where loading the storage cassette into the loading hole of the loading section, and that, when the storage cassette has been loaded into the loading hole and is supported by the loading section, electrically connects the loading section and the storage cassette together. A protective portion is at the loading section, and protrudes out further than the connector in an opposite direction opposite to a loading direction in which the storage cassette is loaded into the loading hole.

13 Claims, 30 Drawing Sheets

(58) Field of Classification Search
USPC ..... 235/379, 475, 482
See application file for complete search history.

(56) References Cited

U.S. PATENT DOCUMENTS

| | | | |
|---|---|---|---|
| 2012/0255829 | A1 | 10/2012 | Togiya |
| 2013/0313773 | A1 | 11/2013 | Komatsu et al. |
| 2014/0054848 | A1 | 2/2014 | Komatsu et al. |

FOREIGN PATENT DOCUMENTS

| | | | |
|---|---|---|---|
| JP | 2014-006884 | A | 1/2014 |
| JP | 2014-044543 | A | 3/2014 |

* cited by examiner

RELATED ART

MEDIUM PROCESSING DEVICE AND MEDIUM TRANSACTION DEVICE

TECHNICAL FIELD

The present disclosure relates to a medium processing device and a medium transaction device, and may be applied, for example, to an automated teller machine that handles paper money serving as a medium.

BACKGROUND ART

In automated teller machines and the like employed in financial institutions or the like, for example, cash such as banknotes and coins are paid in by a customer or paid out to a customer according to the content of the transaction with the customer.

Automated teller machines have been proposed, for example, that include a pay-in/pay-out section that exchanges banknotes with a customer, a classification section that classifies inserted banknotes by denomination, authenticity, condition, and the like, a temporary holding section that temporarily holds inserted banknotes, and storage cassettes that store banknotes by denomination.

In such automated teller machines, when a customer inserts banknotes through a banknote pay-in/pay-out port in a pay-in transaction, the inserted banknotes are classified by the classification section. Banknotes classified as normal are stored in the temporary holding section. Banknotes classified as banknotes that are unsuitable for transaction are returned to the banknote pay-in/pay-out port and given back to the customer. Then, in the automated teller machine, when a pay-in amount is confirmed by customer operation instruction, the denominations of the banknotes stored in the temporary holding section are reclassified by the classification section, and the banknotes are stored in the respective storage cassettes according to their denominations.

Moreover, automated teller machines exist that are provided with a cassette loading section including plural slots to improve the efficiency of an operation to replenish banknotes in the storage cassettes, an operation to recover banknotes from the storage cassettes, or the like, and that are configured such that the storage cassettes can be loaded in or taken out one cassette at a time from the respective slots of the cassette loading section.

For example, a cassette loading section has also been proposed configured so as to be capable of moving along a front-rear direction with respect to a casing of an automated teller machine using slide rails (for example, see Japanese Patent Application Laid-Open (JP-A) No. 2011-118699). The cassette loading section is thus stored inside the casing during operation when the ATM performs various transactions, and the cassette loading section is pulled out to the exterior of the casing during maintenance operations and the like. In the pulled out state of the cassette loading section, the storage cassettes are loaded into or removed from the respective slots of the cassette loading section.

SUMMARY OF INVENTION

Technical Problem

However, the ATM configured as described above is incorporated with various mechanisms for storing or feeding out banknotes to and from each storage cassette, and, for example, several thousands of banknotes are stored in each storage cassette. The total weight of each storage cassette is therefore exceedingly heavy; for example, on the order of 30 kg to 40 kg.

Sturdy slide rails must therefore be employed in the cassette loading section in order to support such heavy weight. However, in comparison to typical slide rails, in cases in which such sturdy rails are employed, there are issues of a larger space being required as well as increased costs.

In consideration of the above, the present disclosure proposes a medium processing device and a medium transaction device capable of reducing the weight of movable portions.

Solution to Problem

In order to address the issues above, a medium processing device of the present disclosure includes a storage cassette that internally stores a medium, a casing that has an internal space for internally storing the storage cassette, a loading section that supports the storage cassette in a state loaded into a loading hole opened in a bottom portion of the loading section, a slide rail that is attached to the casing and the loading section, and that allows the loading section to move between the interior and the exterior of the internal space, and a connector. The connector is provided outside of a pass-through region through which the storage cassette passes when loading the storage cassette into the loading hole of the loading section, and, in a state in which the storage cassette has been loaded into the loading hole and is supported by the loading section, electrically connects the loading section and the storage cassette together. A protective portion is provided to the loading section, and is formed protruding out further than the connector in an opposite direction opposite to a loading direction in which the storage cassette is loaded into the loading hole.

A medium transaction device of the present disclosure includes a storage cassette that internally stores a medium to be transacted with a user or a medium that has been transacted with a user, a casing that has an internal space for internally storing the storage cassette, a loading section that supports the storage cassette in a state loaded into a loading hole opened in a bottom portion of the loading section, a slide rail that is attached to the casing and the loading section, and that allows the loading section to move between the interior and the exterior of the internal space, and a connector. The connector is provided outside of a pass-through region through which the storage cassette passes when loading the storage cassette into the loading hole of the loading section, and that, in a state in which the storage cassette has been loaded into the loading hole and is supported by the loading section, electrically connects the loading section and the storage cassette together. A protective portion is provided to the loading section, and is formed protruding out further than the connector in an opposite direction opposite to a loading direction in which the storage cassette is loaded into the loading hole.

The present disclosure accordingly enables the weight of the loading section to be greatly reduced, and accordingly enables simplification of the slide rails compared to a configuration that covers a lower side of the storage cassette when the storage cassette has been loaded. Moreover, in the present disclosure, although the connector of the loading section is inevitably disposed at a location that can be easily touched from the outside, the protection portion is capable of preemptively preventing damage due to impact from the storage cassettes or the like.

Advantageous Effects of Invention

The present disclosure enables a medium processing device and a medium transaction device capable of reducing the weight of movable portions can be realized.

DESCRIPTION OF EMBODIMENTS

Explanation follows regarding embodiments for implementing the present disclosure (referred to below as exemplary embodiments), with reference to the drawings.

1. First Exemplary Embodiment

1-1. ATM Configuration

Figure 1:
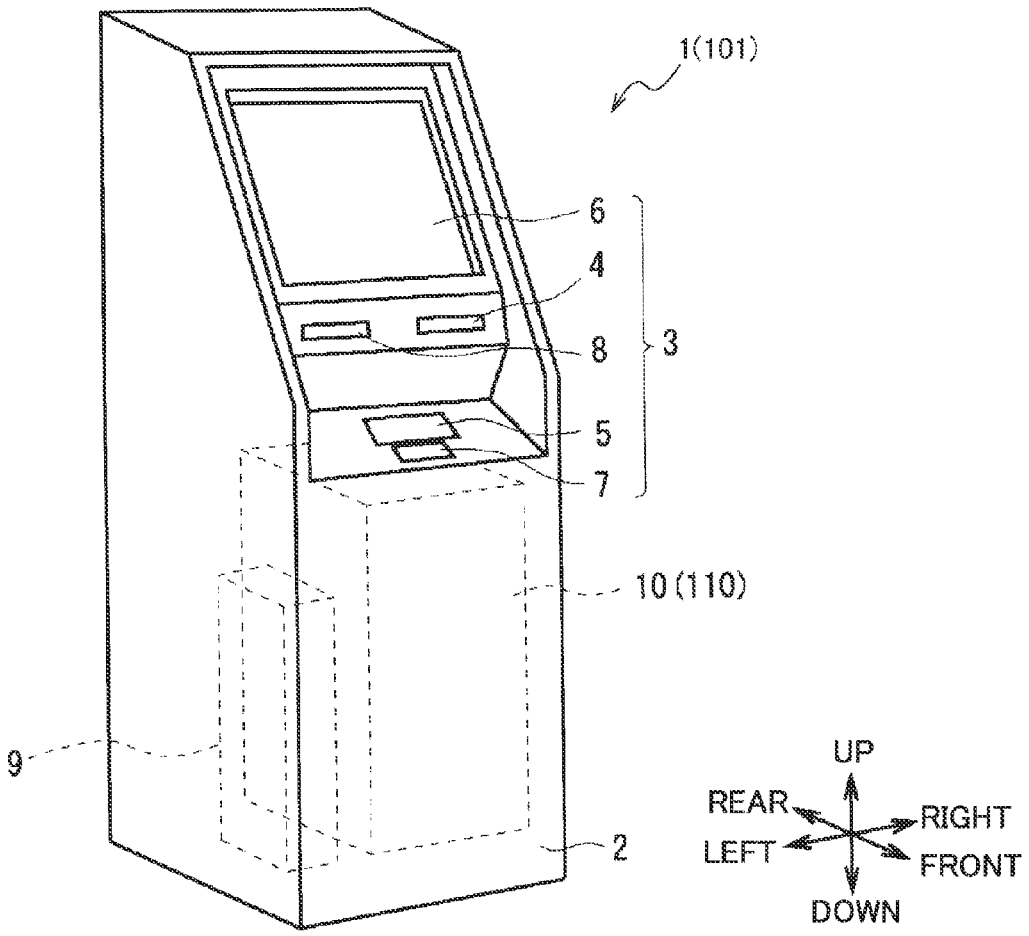
FIG. 1 is a schematic perspective view illustrating configuration of an ATM.

As illustrated in the external view in FIG. 1, an ATM 1 includes a box shaped casing 2 and is, for example, installed in a financial institution or the like to perform cash transactions such as pay-in transactions and pay-out transactions with a customer.

The casing 2 includes a customer interface 3 at a location enabling easy banknote insertion, easy operation of a touch panel, and the like by a customer facing the front side of the casing 2. The customer interface 3 is provided with a card insertion/removal port 4, a pay-in/pay-out port 5, an operation and display section 6, a ten-key 7, and a receipt issue port 8. The customer interface 3 directly handles cash and passbook transactions with the customer, for example, and notifies transaction-related information and receives operation instructions.

The card insertion/removal port 4 is a section where various cards, such as cash cards are inserted and returned. A card processor that reads, for example, account numbers magnetically recorded on various cards is provided inside casing of the card insertion/removal port 4. The pay-in/pay-out port 5 is a section where banknotes paid in by a user are inserted, and where banknotes for paying out to a user are dispensed. The pay-in/pay-out port 5 opens and closes by driving a shutter. Note that banknotes serving as a medium are, for example, configured from rectangular shaped paper.

The operation and display section 6 is integrated with a Liquid Crystal Display (LCD) that displays operation screens during transactions, and a touch panel that is input with, for example, a transaction type selection, a PIN, or a transaction amount. The ten-key 7 is, for example, a physical keypad that is input with the numbers 0 to 9. The ten-key 7 is employed during PIN and transaction amount input operations and the like. The receipt issue port 8 is a section that issues a receipt printed with transaction details and the like at the end of transaction processing. A receipt processor that prints transaction details and the like on a receipt is provided inside casing of the receipt issue port 8.

In the following explanation, the front side is defined as the side of the ATM 1 that a customer faces, and the opposite side thereto is defined as the rear side. The left side, right side, upper side and lower side are defined from the perspective of the left and right as seen by a customer facing the front side.

A rear door covering a rear face of the casing 2 is configured capable of opening and closing. The casing 2 protects internally stored banknotes, coins, and the like by closing the rear door, for example, during transaction operations in which cash transactions with a customer are performed. During an operation in which a member of staff of the financial institution, a technician, or the like performs a maintenance operation or a banknote replenishment/retrieval operation or the like, each section inside the casing 2 can easily be worked on by opening the rear door as necessary.

A main controller 9 that performs integrated control of the overall ATM 1, a banknote pay-in/pay-out device 10 that performs various processing relating to banknotes, and the like, are provided inside the casing 2

The main controller 9 is configured around a Central Processing Unit (CPU). The main controller 9 reads and executes specific programs from Read Only Memory (ROM), flash memory, or the like to perform various processing such as pay-in processing and pay-out processing. The main controller 9 is provided with an internal storage section including Random Access Memory (RAM), a hard disk drive, flash memory, or the like. The storage section is stored with various information.

1-2. Configuration of Banknote Pay-In/Pay-Out Device

Figure 2:
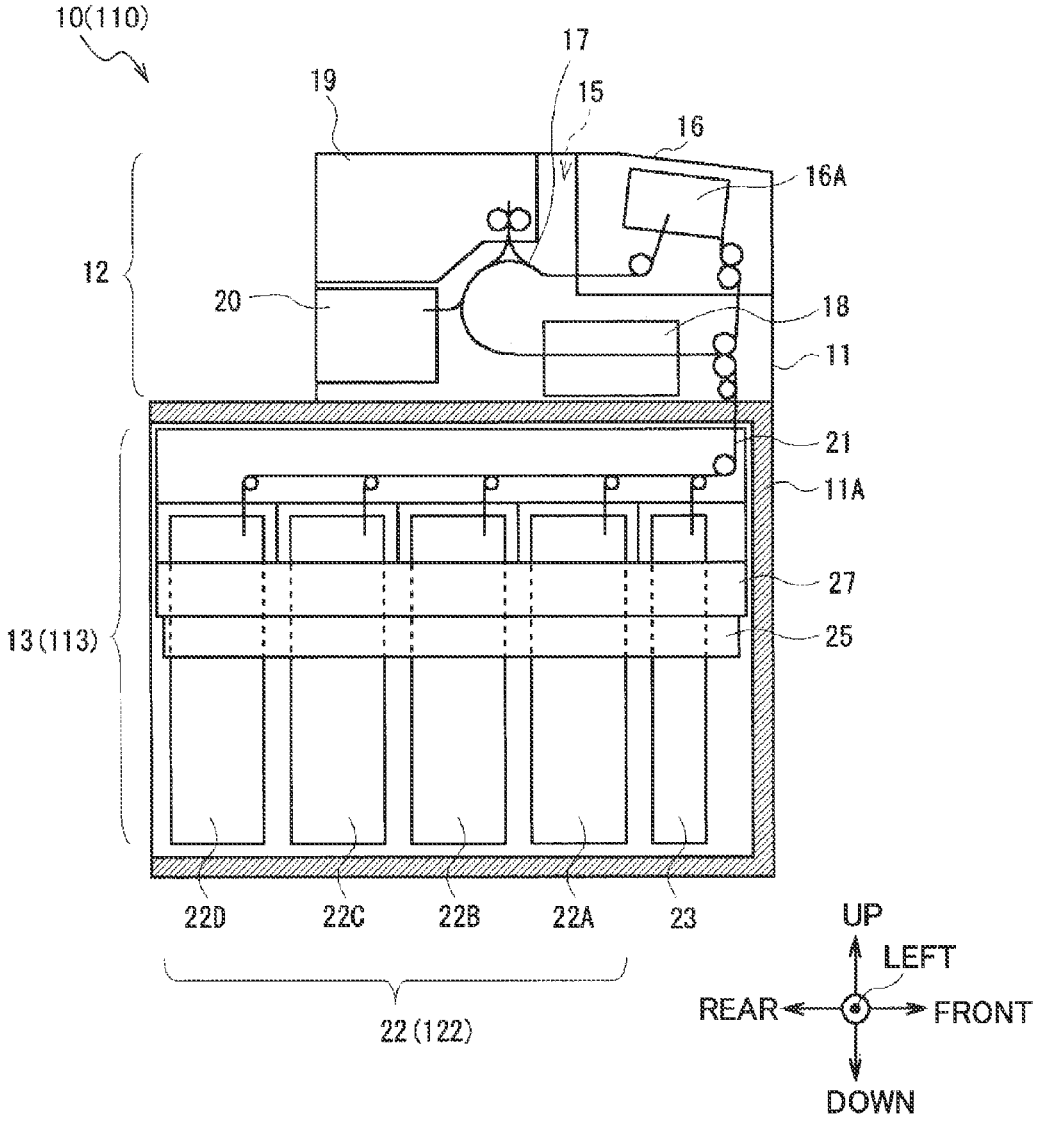
FIG. 2 is a schematic diagram illustrating configuration of a banknote pay-in/pay-out device.

As illustrated in schematic side view in FIG. 2, the banknote pay-in/pay-out device 10 is incorporated with various mechanisms for performing pay-in processing and pay-out processing of banknotes inside a banknote pay-in/pay-out device casing 11. The banknote pay-in/pay-out device 10 is configured broadly split into an upper section unit 12 on the upper side, and a lower section unit 13 on the lower side.

The upper section unit 12 is incorporated with a banknote controller 15, a pay-in/pay-out section 16, an upper conveyance section 17, a classification section 18, a temporary holding section 19, and a counterfeit note storage box 20. The lower section unit 13 is provided with a lower conveyance section 21, storage cassettes 22 (22A, 22B, 22C, and 22D), and a reject cassette 23.

The banknote controller 15 performs integrated control of the banknote pay-in/pay-out device 10 coordinated with the main controller 9. Similarly to the main controller 9, the banknote controller 15 includes a CPU, and reads and executes specific programs from ROM, flash memory, or the like to control various processing relating to banknotes, such as pay-in processing and pay-out processing of banknotes. The banknote controller 15 is provided with an internal storage section including RAM, flash memory, or the like. The storage section is stored with various information.

The pay-in/pay-out section 16 (FIG. 2) includes an internal box shaped receptacle 16A. The receptacle 16A houses banknotes to be passed to a user, or banknotes received from a user. The pay-in/pay-out section 16 further includes a shutter that opens and closes an upper side of the receptacle 16A, and a separator for separating banknotes housed inside the receptacle 16A one note at a time and passing the banknotes to the upper conveyance section 17.

The upper conveyance section 17 forms a conveyance path (illustrated by solid lines in the figures) connecting together each section inside the upper section unit 12 and the lower conveyance section 21 with motors, rollers, belts, guides, and the like. The upper conveyance section 17 rotates the rollers as appropriate, and moves the belts as appropriate, to convey banknotes along the conveyance path in a direction of travel aligned with the short edges of the banknotes.

The classification section 18 includes various internal sensors such as optical sensors, image sensors, and magnetic sensors. Based on the detection results obtained from the various sensors, the classification section 18 determines the denomination of banknotes, determines whether banknotes are authentic or counterfeit (referred to as counterfeit notes), determines the degree of damage, and the like, and notifies these results as classification results to the banknote controller 15. In response, the banknote controller 15 decides the conveyance destination of each banknote based on the obtained classification results.

The temporary holding section 19 employs what is referred to as a tape escrow method, and stores banknotes by wrapping the banknotes against a circumferential side face of a circular cylinder shaped drum together with a tape, and feeds out the banknotes by peeling the tape away from the circumferential side face. The counterfeit note storage box 20 stores banknotes determined by the classification section 18 to be counterfeit notes.

Similarly to the upper conveyance section 17, the lower conveyance section 21 forms a conveyance path respectively connecting together each section inside the lower section unit 13 and the upper conveyance section 17 with motors, rollers, belts, guides, and the like to convey banknotes along the conveyance path.

The storage cassettes 22 (22A, 22B, 22C, and 22D) stack and store multiple banknotes internally. When storing banknotes, the storage cassettes 22 take in and store the banknotes conveyed by the lower conveyance section 21. When feeding out banknotes, the storage cassettes 22 separate and feed out the stored banknotes one note at a time and pass the banknotes to the lower conveyance section 21 in sequence. Banknotes that the classification section 18 has classified as having a high level of damage and to be unsuitable for re-use (referred to as reject banknotes) are stored in the reject cassette 23.

In cases in which, for example, a customer performs a pay-in transaction with the ATM 1, in coordination with the main controller 9 and the like, after receiving specific operation input from the operation and display section 6, the banknote controller 15 opens the pay-in/pay-out port 5 (FIG. 1) shutter to allow insertion of banknotes into the pay-in/pay-out section 16.

When banknotes have been inserted, the pay-in/pay-out section 16 shuts the shutter of the pay-in/pay-out port 5, and then takes out the banknotes one note at a time and passes the banknotes to the upper conveyance section 17. The upper conveyance section 17 conveys the received banknotes to the classification section 18 for classification, and the banknote controller 15 is notified of the classification results. The banknote controller 15 decides the conveyance destination of each banknote based on the acquired classification results.

When this is performed, the upper conveyance section 17, for example, conveys banknotes classified by the classification section 18 as normal (referred to as normal notes) to the temporary holding section 19 where they are temporarily held. The upper conveyance section 17 conveys banknotes classified as unsuitable for transactions or anything that is not a banknote (for example, receipts) to the pay-in/pay-out section 16 for returning to the customer.

Then, after the customer has been prompted to confirm the pay-in amount using the operation and display section 6 (FIG. 1), the banknote controller 15 conveys the banknotes held in the temporary holding section 19 to the classification section 18 where the banknotes are classified by denomination, degree of damage, and the like, and acquires the classification results.

The banknote controller 15 controls the upper conveyance section 17 and the lower conveyance section 21 such that banknotes with a high level of damage are conveyed to and stored in the reject cassette 23 as reject banknotes that are unsuitable for re-use, and banknotes with a low level of damage are sorted according to denomination and passed to the storage cassettes 22 as banknotes suitable for re-use. The storage cassettes 22 internally stack and store the received banknotes.

However, in cases in which, for example, a customer performs a pay-out transaction with the ATM 1, in coordination with the main controller 9 and the like, after receiving specific operation input from the operation and display section 6 (FIG. 1), the banknote controller 15 feeds out banknotes from the storage cassettes 22 according to the amount to be paid out.

The banknote controller 15 then uses the lower conveyance section 21 and the upper conveyance section 17 to convey the banknotes to the classification section 18 for classification, before conveying the banknotes to the pay-in/pay-out section 16 and opening the pay-in/pay-out port 5 (FIG. 1) shutter to allow the customer to take out the banknotes.

In this manner, in pay-in transactions, the banknote pay-in/pay-out device 10 uses the lower conveyance section 21 to sort banknotes paid in by the customer and store the banknotes in the storage cassettes 22, and in pay-out transactions, the banknote pay-in/pay-out device 10 feeds out banknotes from the storage cassettes 22 for payout to the customer.

1-3. Configuration of Lower Section Unit

Figure 3:
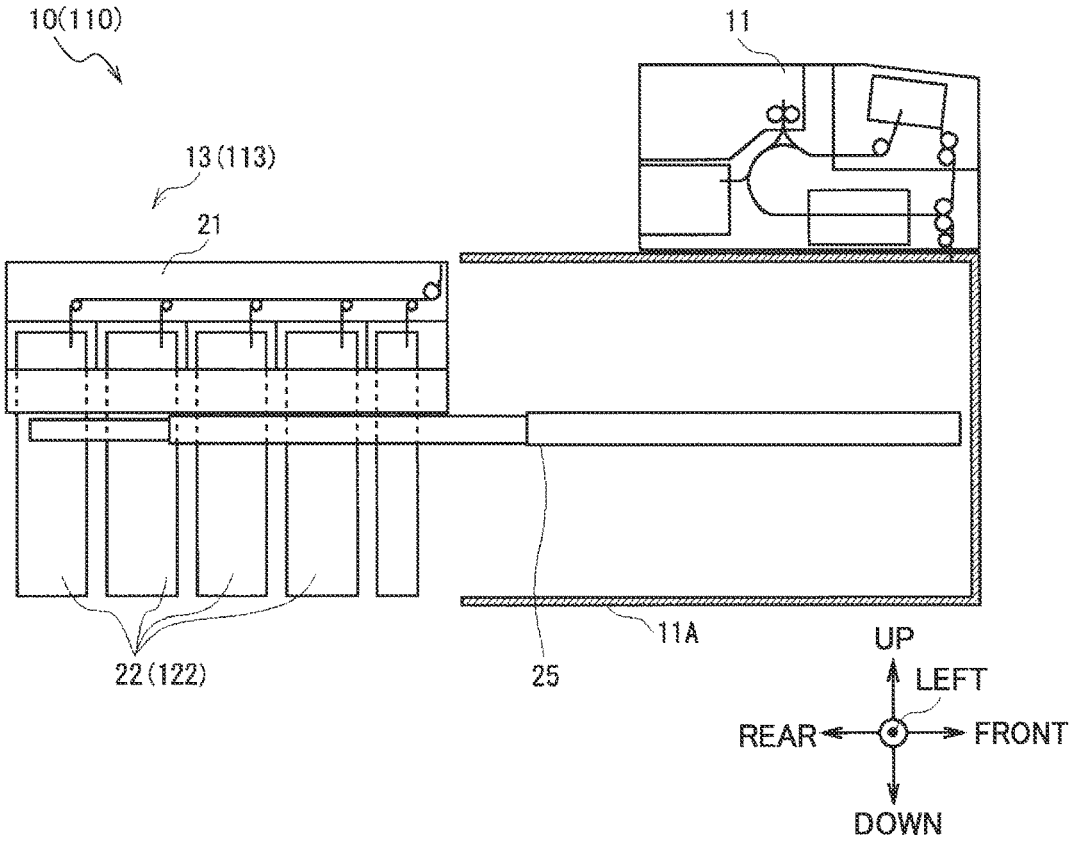
FIG. 3 is schematic diagram to illustrate pulling out of a lower section unit.

As illustrated in FIG. 3, the lower section unit 13 is attached to a lower section casing 11A formed to a lower side portion of the banknote pay-in/pay-out device casing 11 so as to be capable of moving in a front-rear direction using slide rails 25 that extend and retract in the front-rear direction. When moved rearward from a state stored inside the lower section casing 11A (FIG. 2), the lower section unit 13 adopts a state pulled out from the lower section casing 11A (FIG. 3), and when moved forward from this state, the lower section unit 13 again returns to the stored state (FIG. 2).

Figure 4:
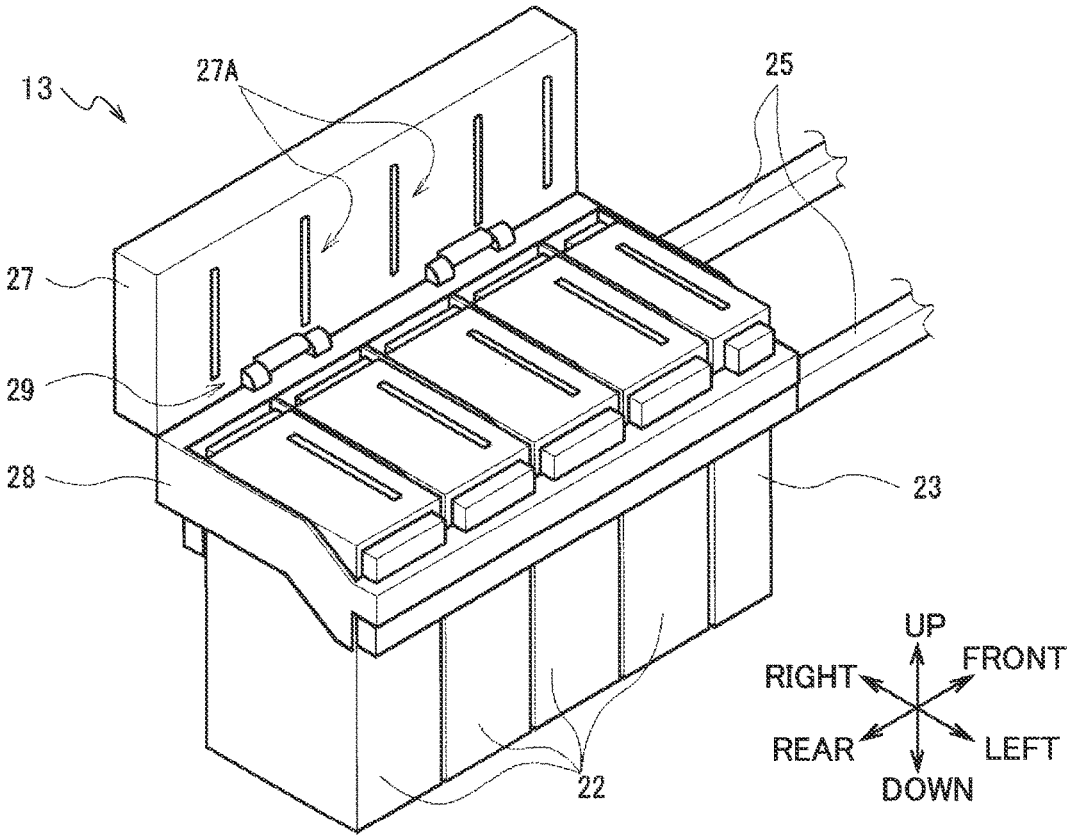
FIG. 4 is a schematic diagram illustrating configuration of a lower section unit.

A rectangular block shaped space that is long in the front-rear direction is formed inside the lower section casing 11A. The external profile of the lower section unit 13 is formed in a rectangular block shape so as to fit inside this space. As illustrated in FIG. 4, the lower section unit 13 is configured broadly split into a lid body 27 on an upper side and a loading section 28 on a lower side.

The lid body 27 is configured overall with a rectangular block shape that is thin in the up-down direction, and the lower conveyance section 21 is internally incorporated therein (FIG. 2). Plural hand-over ports 27A for respectively handing-over banknotes to and from each storage cassette 22 are formed in a side of a face (referred to below as cassette-facing face) of the lid body 27 facing the storage cassettes 22.

The lid body 27 is attached to the loading section 28 so as to be capable of swinging about hinges 29. Namely, by swinging about the hinges 29, the lid body 27 can transition between a closed state in which the cassette-facing face faces downward and closes off the upper side of the loading section 28 as illustrated in FIG. 2, and an open state swung approximately 90 degrees from the closed state such that the cassette-facing face faces the left direction to open up the upper side of the loading section 28, as illustrated in FIG. 4.

Although the loading section 28 is internally loaded with the storage cassettes 22, a lower side portion of the loading section 28 is mainly open. The storage cassettes 22 are supported so as to be suspended from an upper side portion of the loading section 28, and lower side portions of the loaded storage cassettes 22 are exposed to the exterior.

Figure 5:
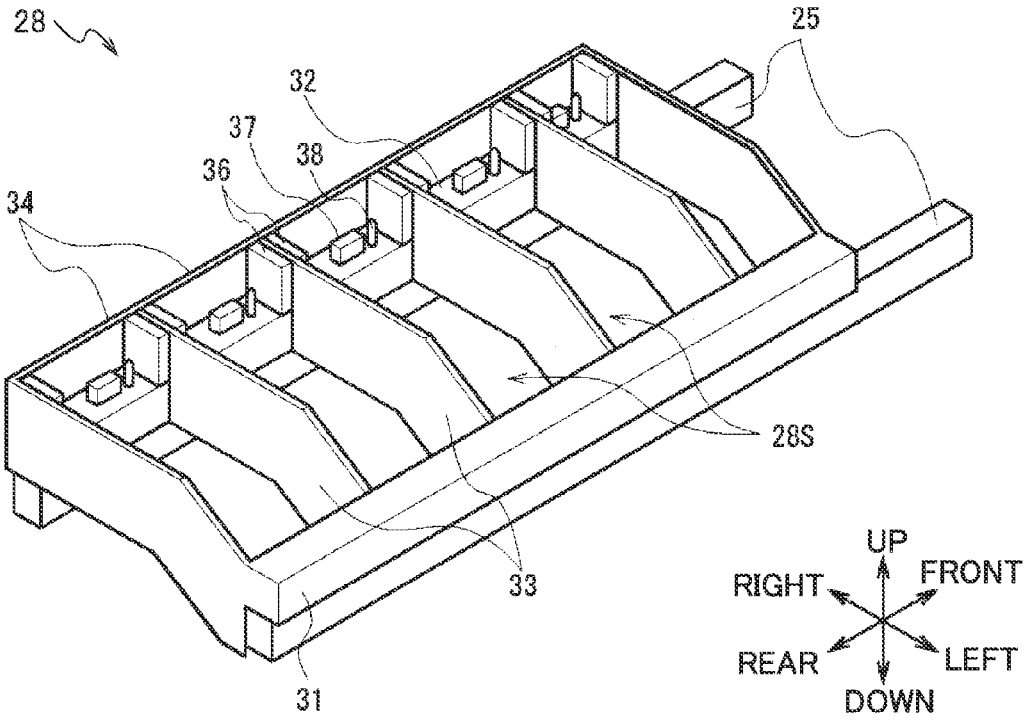
FIG. 5 is a schematic perspective view illustrating configuration of a loading section according to a first exemplary embodiment.
Figure 6A:
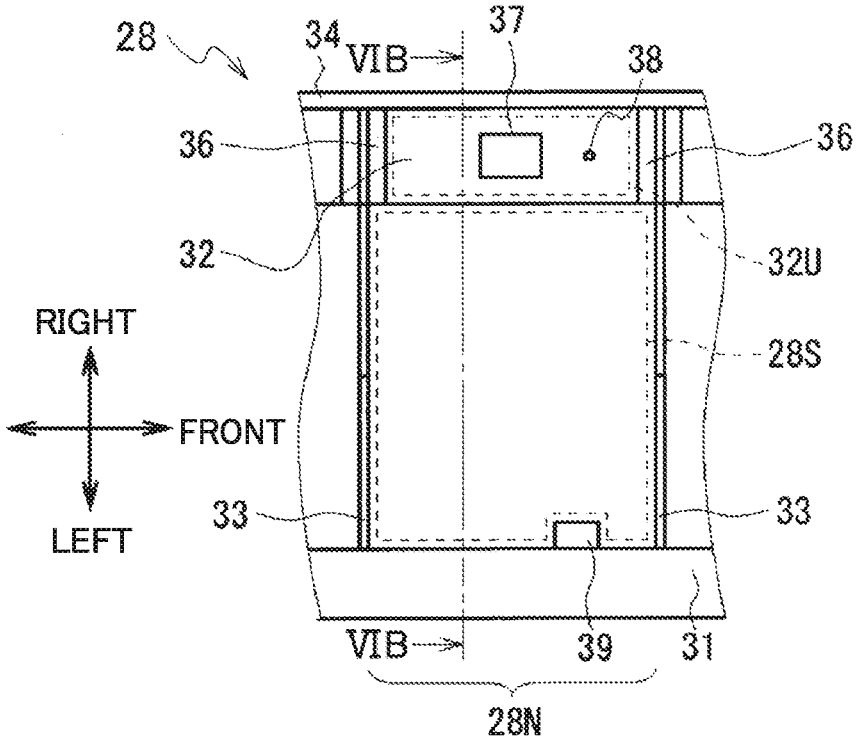
FIG. 6A is a schematic diagram illustrating configuration of a loading section according to the first exemplary embodiment.
Figure 6B:
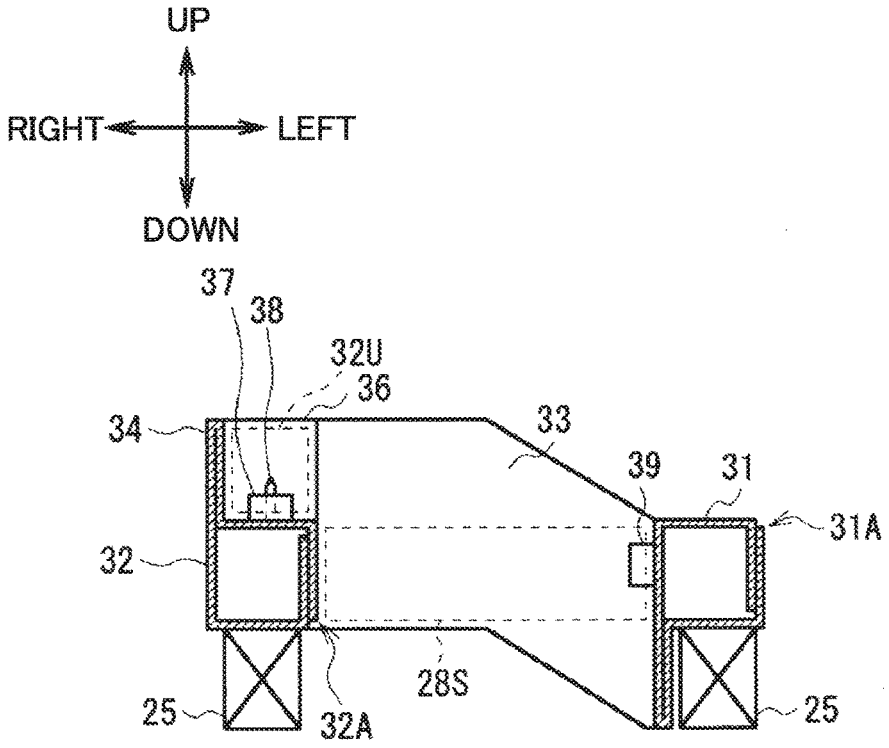
FIG. 6B is a schematic diagram illustrating configuration of a loading section according to the first exemplary embodiment.
Figure 6C:
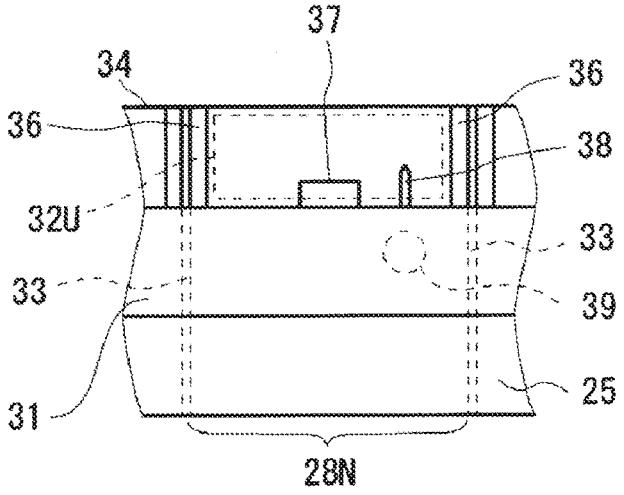
FIG. 6C is a schematic diagram illustrating configuration of a loading section according to the first exemplary embodiment.

As illustrated in perspective view in FIG. 5 and in partial plan views in FIG. 6A and FIG. 6C, overall, there are plural partitioning plates 33 discretely disposed across the loading section 28 so as to span between a left frame 31 and a right frame 32, and form rectangular frame shapes as viewed from above.

As illustrated in FIG. 6B, in a cross-section taken along VIB-VIB in FIG. 6A, the left frame 31 is formed in a hollow angular column shape that is long along the front-rear direction. In the left frame 31, a thin metal plate is bent so as to form a hollow angular column shaped portion, and to form an extension portion extending downward from a right side face of the left frame 31. No other components or the like are disposed on an upper face of the left frame 31.

In the right frame 32, a thin metal plate is bent so as to form a hollow angular column shaped portion similar to that of the left frame 31, and to form a right protective plate 34 with a portion extending upward at a right side edge of the right frame 32.

The left frame 31 and the right frame 32 are each formed with rounded ridge portions by bending metal plates, and are welded at end faces 31A and 32A where the metal plates were cut. The left frame 31 and the right frame 32 thereby maintain their angular column shapes and an effect similar to that of chamfering is achieved, enabling injury to be prevented when handled by a technician or the like during manufacture or during maintenance operations.

Each partitioning plate 33 (FIG. 5) is formed in a plate shape that is thin in the front-rear direction, and is a shape formed by obliquely cutting away an upper left portion, and cutting away a trapezoidal shape from a lower right portion. Upper edges of the partitioning plates 33 are aligned to the same height as an upper end of the right protective plate 34, and upper ends of left edges of the partitioning plates 33 are set to the same height as the upper face of the left frame 31. Namely, upper side portions of the partitioning plates 33 are positioned higher than an upper face of the right frame 32.

The partitioning plates 33 are respectively disposed between the left frame 31 and the right frame 32 every specific interval so as to form loading holes 28S. However, the interval between the two partitioning plates 33 furthest to the front side is shorter than the intervals at other locations. The loading hole 28S at a location furthest to the front side is therefore narrower than those at other locations.

As illustrated in FIG. 4, the reject cassette 23 is loaded into the comparatively narrow loading hole 28S at the location furthest to the front side, and the respective storage cassettes 22 are loaded into the loading holes 28S at the remaining four comparatively wide locations, by being moved downward (in what is referred to below as the loading direction) from the upper side. The loading holes 28S are slots for loading the storage cassettes 22 and the reject cassette 23.

Ranges containing one loading hole 28S and left and right outer sides of the loading hole 28S are referred to below as individual loading ranges 28N. Explanation follows regarding the individual loading ranges 28N. FIG. 6A and FIG. 6C are plan views centered on one individual loading range 28N of the loading section 28.

Two protective bodies 36, a loading section side connector 37, and a positioning pin 38 are provided to an upper face of the right frame 32 in each individual loading range 28N. The protective bodies 36 are formed in rectangular block shapes. The protective bodies 36 have a similar length to that of the right frame 32 along a left-right direction, serving as a first intersecting direction, and have a length similar to the height of the right protective plate 34 in the up-down direction. The respective protective bodies 36 are disposed so as to be adjacent to the respective partitioning plates 33 positioned at the front and rear of the individual loading range 28N.

The length of a space (referred to below as right frame upper portion space 32U) along the front-rear direction, serving as a second intersecting direction, interposed between the two protective bodies 36 on the upper face of the right frame 32, is shorter than a front-rear direction length of the loading hole 28S. Left side faces of the protective bodies 36, namely, side faces on the loading hole 28S side, are disposed aligned with the left side face of the right frame 32, and form continuous flat faces together with the right frame 32. From another point of view, in the individual loading range 28N, out of the respective front, rear, left, and right members enclosing the loading hole 28S, the left side member alone is relatively low, and the members along each of the other directions are relatively high.

The loading section side connector 37 is formed in a comparatively small rectangular block shape, and an upper face of the loading section side connector 37 is at a position sufficiently lower than upper edges of the right protective plate 34, the protective bodies 36, and the partitioning plates 33. Electric power is supplied to the loading section side connector 37. Plural connection terminals for transmitting various electrical signals are provided to the loading section side connector 37. The loading section side connector 37 is positioned substantially at the front-rear direction center of the right frame upper portion space 32U.

The loading section side connector 37 is electrically connected to the banknote pay-in/pay-out device casing 11 side by a wiring member. The wiring member is disposed inside the right frame 32 so as not to be externally exposed when pulling out the loading section 28. Maintenance technicians or the like accidentally snagging the wiring on the storage cassettes 22 or on tools, disconnected wires, and the like, can thereby be preemptively avoided in the loading section 28.

The positioning pin 38 is formed in an elongated circular column shape with its axis along the up-down direction. An upper end of the positioning pin 38 is formed in a cone shape. The upper end of the positioning pin 38 is lower than the upper edges of the right protective plate 34, but higher than the upper face of the loading section side connector 37. The positioning pin 38 is formed at a position in the vicinity of the loading section side connector 37, and more specifically, formed at a position separated from the loading section side connector 37 by a specific distance.

A positioning projection 39 that protrudes out toward the inside of the respective loading hole 28S is provided projecting from the right side face of the left frame 31. The positioning projection 39 is formed in a circular column shape with its axis along the left-right direction. The front-rear direction position of the positioning projection 39 is substantially in-phase with that of the positioning pin 38 provided to the upper face of the right frame 32, namely, aligned to the same position at the inside of the individual loading range 28N.

1-4. Configuration of Storage Cassettes

Next, explanation follows regarding the storage cassettes 22. As illustrated in perspective view in FIG. 7 and as illustrated in plan view as viewed from different directions in FIG. 8A to FIG. 8E, each storage cassette 22 includes a casing 41 forming an outer profile of the respective storage cassette 22.

The casing 41 is formed overall in a rectangular block shape that is long in the up-down direction and relatively short in the front-rear direction. A front-rear direction length of the casing 41 is slightly shorter than that of the loading holes 28S (FIG. 6A) of the loading section 28, but is longer than the spacings between the respective protective bodies 36. A left-right direction length of the casing 41 is slightly shorter than a left-right direction length of the loading hole 28S.

An elongated slit shaped insertion hole 42 with its length direction along the left-right direction is formed at a position toward the front of an upper face of the casing 41. The insertion hole 42 allows loading of banknotes in the up-down direction, and allows the banknotes to be moved between the interior and the exterior of the casing 41, in a state in which the length direction of banknotes runs along from left to right, and the sheet faces of the banknotes face the front and rear. When the lid body 27 is in the closed state (FIG. 2), the insertion hole 42 is aligned with the front-rear direction and left-right direction positions of the hand-over port 27A, such that banknotes pass between the insertion hole 42 and the hand-over port 27A.

The inside of the casing 41 is formed with a storage space in which a large amount of banknotes (for example, 3000 notes) are stacked and stored, and is provided with a conveyance mechanism or the like for conveying the banknotes between the insertion hole 42 and the storage space. The conveyance mechanism conveys the banknotes by using an actuator, acting as a motion source, to generate rotational force, transmitting this rotational force to rollers through specific gears or the like, and transferring drive force to the banknotes from the rollers. The inside of the casing 41 is provided with sensors for detecting the stacking state, the conveyance state, and the like of the banknotes.

In the vicinity of the upper face of the casing 41, a rear edge and rear-half portions of both left and right edges of the casing 41 are formed with an indentation that runs around the outer periphery, and a handle 43 is attached so as to fit into the indentation. The handle 43 is configured by a grip portion 43A running along the left-right direction, and arm portions 43B provided extending toward the front perpendicular to left and right ends of the grip portion 43A. Front ends of the arm portions 43B of the handle 43 are attached to the vicinity of the upper face of the casing 41 so as to be capable of swinging about a specific swing axis.

Figure 7:
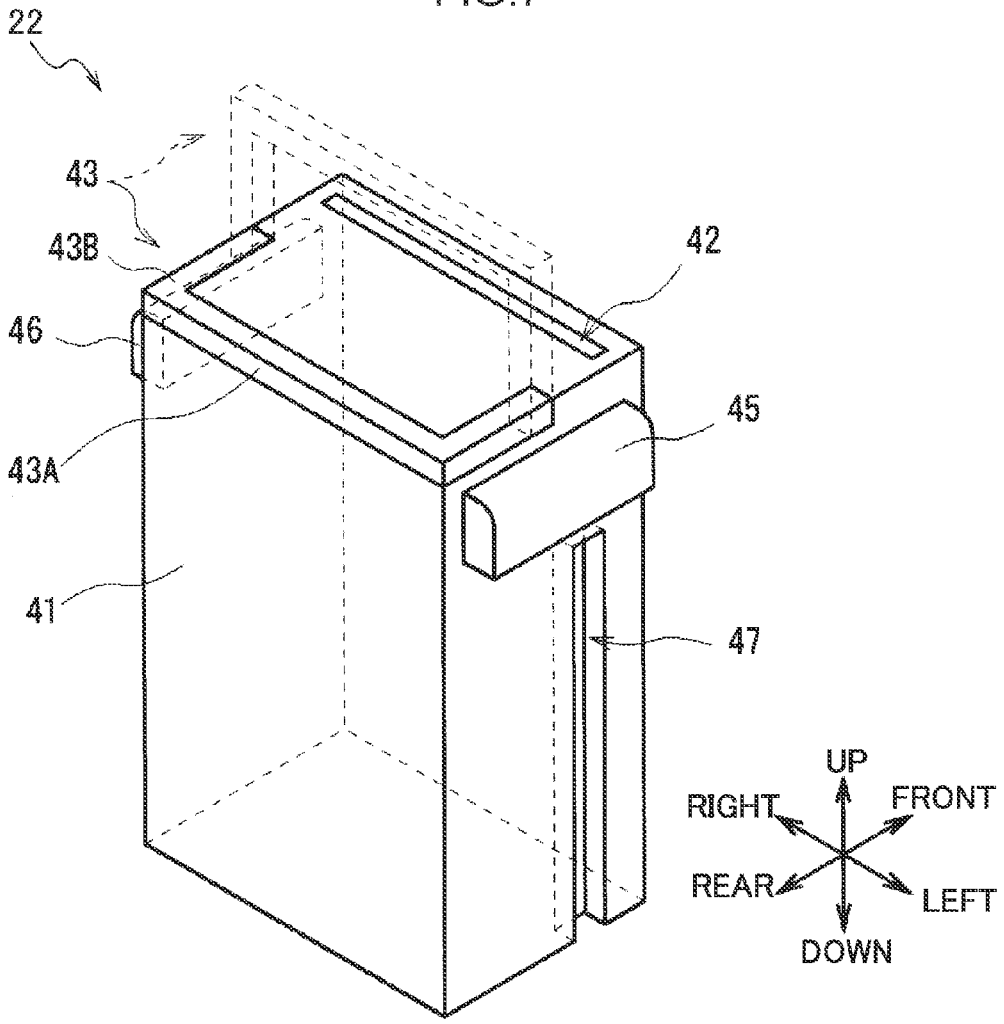
FIG. 7 is a schematic perspective view illustrating configuration of a storage cassette according to the first exemplary embodiment.

By being swung by a technician or the like, the handle 43 can freely transition between a stored state in which, as illustrated by solid lines in FIG. 7, the arm portions 43B are laid down substantially horizontally such that a protrusion amount from the casing 41 is suppressed to a minimum, and an upright state in which, as illustrated by dashed lines in FIG. 7, the arm portions 43B stand substantially vertically so as to be easily grippable.

A left protrusion portion 45 and a right protrusion portion 46 that respectively protrude outward toward the left and right are provided to the vicinity of upper ends of both left and right side faces of the casing 41. The left protrusion portion 45 is formed in a rectangular block shape that is comparatively long in the front-rear direction and comparatively short in the left-right direction. A front face of the left protrusion portion 45 is positioned further toward the rear side than a front face of the casing 41. A rear face of the left protrusion portion 45 is positioned further to the front side than a rear face of the casing 41. Namely, a front-rear direction length of the left protrusion portion 45 is shorter than a front-rear direction length of the casing 41. The right protrusion portion 46 is formed substantially with left-right symmetry with respect to the left protrusion portion 45.

Figure 8A:
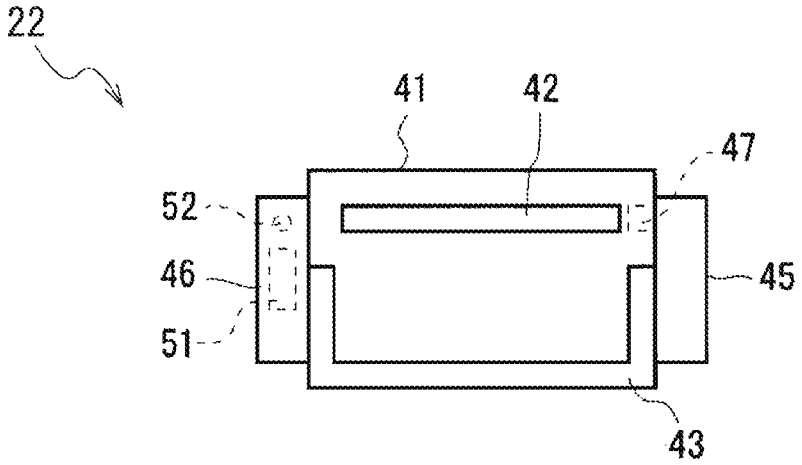
FIG. 8A is a schematic diagram illustrating configuration of a storage cassette according to the first exemplary embodiment.
Figure 8B:
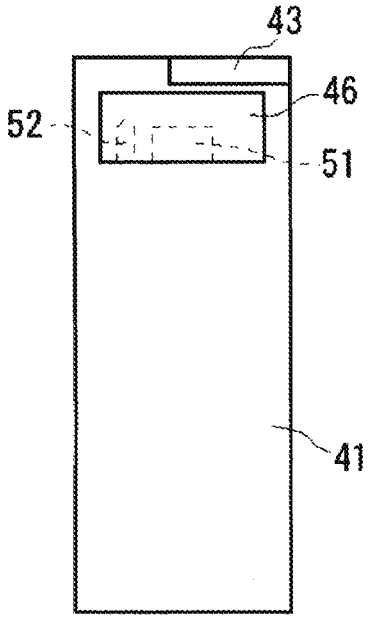
FIG. 8B is a schematic diagram illustrating configuration of a storage cassette according to the first exemplary embodiment.
Figure 8C:
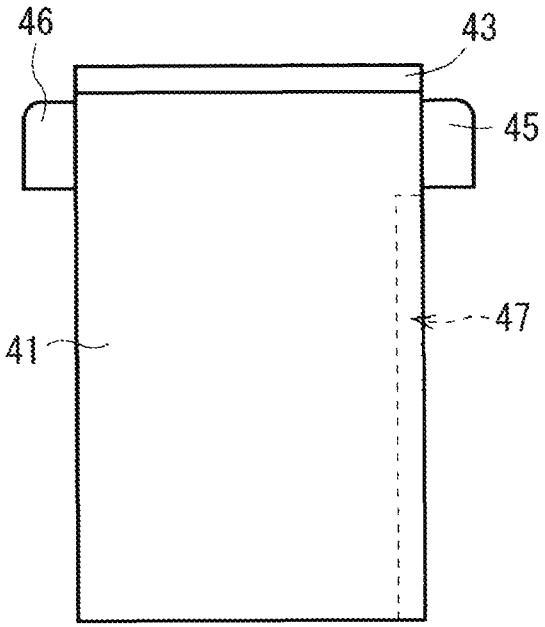
FIG. 8C is a schematic diagram illustrating configuration of a storage cassette according to the first exemplary embodiment.
Figure 8D:
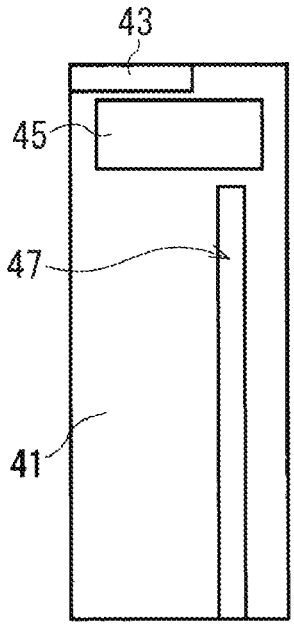
FIG. 8D is a schematic diagram illustrating configuration of a storage cassette according to the first exemplary embodiment.
Figure 8E:
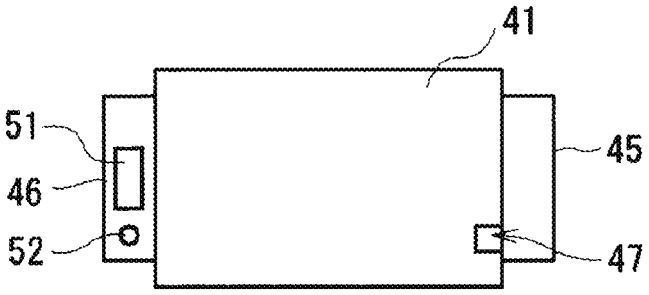
FIG. 8E is a schematic diagram illustrating configuration of a storage cassette according to the first exemplary embodiment.

A guide groove 47 running along the up-down direction is formed in a left side face of the casing 41 further to the lower side than the left protrusion portion 45. As illustrated in FIG. 8A, a front-rear direction position of the guide groove 47 is aligned so as to be substantially in-phase with the insertion hole 42.

A cassette side connector 51 and a positioning hole 52 are further provided inside the right protrusion portion 46. The cassette side connector 51 is configured in a shape corresponding to the loading section side connector 37 of the loading section 28, and is provided with plural connection terminals for transmitting electric power to drive the actuator described above, electrical signals representing the detection results from the sensors described above, and the like. The cassette side connector 51 is disposed at substantially the front-rear center of the right protrusion portion 46, and a lower face of the cassette side connector 51 is exposed at a lower side of the right protrusion portion 46.

The positioning hole 52 is disposed in the right protrusion portion 46 further to the front than the cassette side connector 51, and is a round hole penetrating upward from a lower face of the right protrusion portion 46. A front-rear direction position of the positioning hole 52 is aligned substantially in-phase with the insertion hole 42 and the guide groove 47.

Although the reject cassette 23 partly differs from the storage cassettes 22 in front-rear direction length and in configuration of various internally incorporated mechanisms, configuration of the reject cassette 23 is substantially the same in other respects.

1-5. Loading Operation of the Storage Cassettes into the Loading Section

Explanation follows regarding a loading operation in which the storage cassette 22 is loaded into the loading hole 28S of the loading section 28 of the banknote pay-in/pay-out device 10, explained in stages by splitting up into a number of steps.

When the storage cassette 22 is properly loaded into the loading hole 28S of the loading section 28 of the banknote pay-in/pay-out device 10, the handle 43 (FIG. 7) is gripped and lifted by a technician or the like, and the storage cassette 22 is lowered directly downward in a state in which each of the front, rear, left, and right side faces and the lower face of the storage cassette 22 are substantially parallel with each of the respective front, rear, left, and right inside faces of the loading hole 28S. For ease of explanation, the angle at which each side face of the storage cassette 22 is substantially parallel to the respective inside faces of the loading section 28 is referred to as the proper angle, and the position at which the storage cassette 22 is properly loaded into the loading section 28 is referred to as the proper position.

Figure 9:
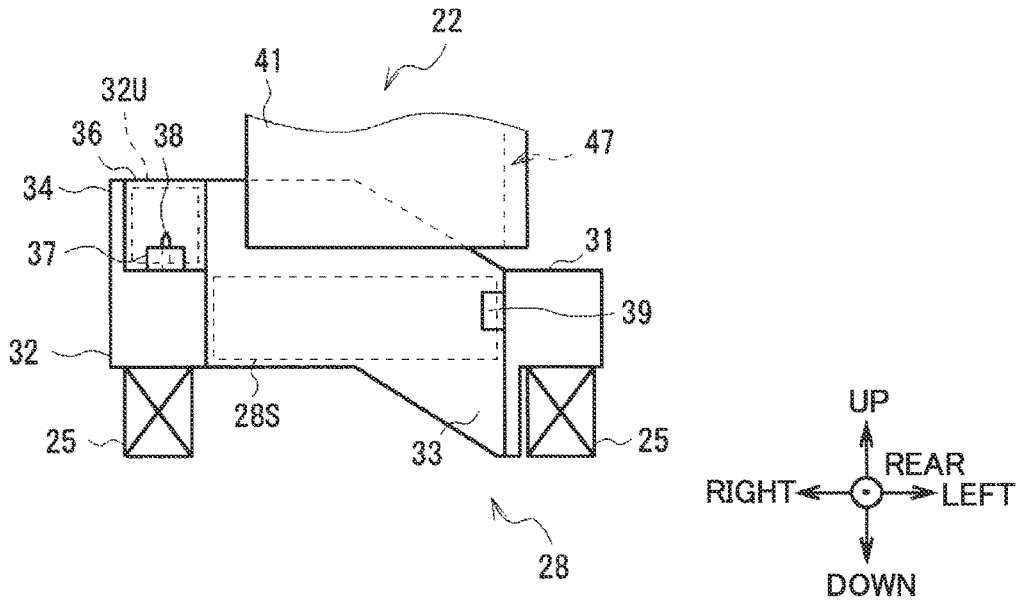
FIG. 9 is a schematic diagram illustrating loading of a storage cassette (first state) in the first exemplary embodiment.

When the storage cassette 22 has an orientation that it does not differ greatly from the proper angle due to being adjusted by a maintenance technician, and is positioned above and to the left of the proper position, as illustrated in FIG. 9, first, the vicinity of a lower end of the storage cassette 22 is positioned between the partitioning plates 33, and a lower left end of the storage cassette 22 is positioned above the left frame 31. This state is referred to below as the first state. In the figures following FIG. 9, the loading section 28 and the storage cassette 22 are shown schematically as viewed from the rear or from above, and are partially simplified or omitted.

In the first state, the loading section 28 can substantially align the position of the storage cassette 22 along the front-rear direction to the proper position due to causing the vicinity of the lower end of the storage cassette 22 to enter between the front and rear partitioning plates 33.

Figure 10:
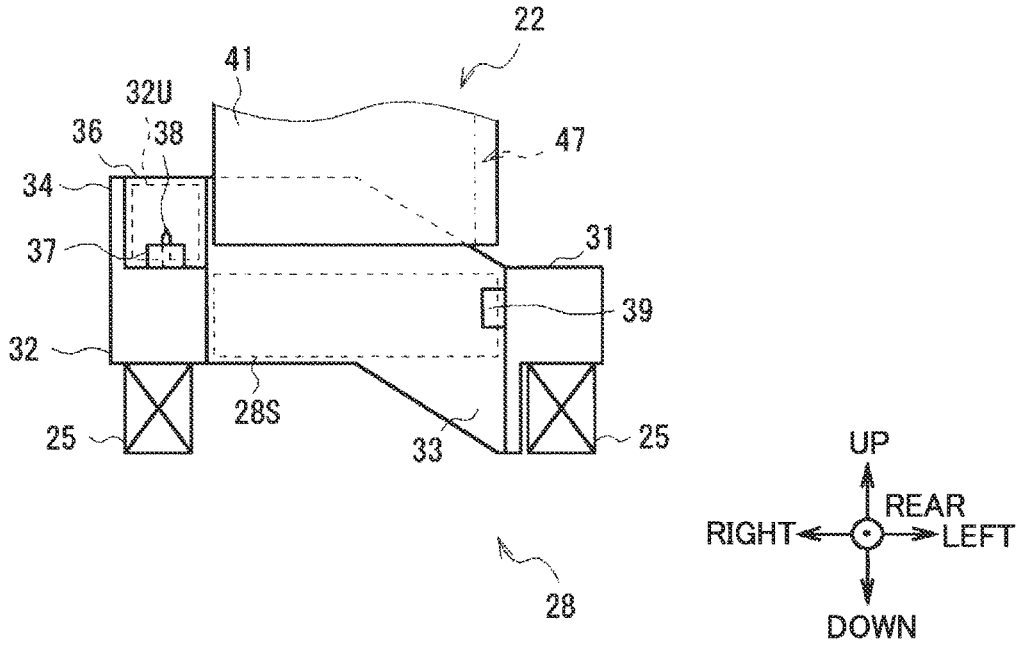
FIG. 10 is a schematic diagram illustrating loading of a storage cassette (second state) in the first exemplary embodiment.

In the first state, when a technician or the like applies force so as to press the storage cassette 22 toward the right, the storage cassette 22 moves toward the right, and as illustrated in FIG. 10, the right side face of the storage cassette 22 is abutted against the left side faces of the respective protective bodies 36. This state is referred to below as the second state. In the second state, the left-right direction position of the storage cassette 22 with respect to the loading section 28 can be aligned to the proper position by causing both front and rear ends in the vicinity of the lower end of the right side face of the storage cassette 22 to abut the left side faces of the respective protective bodies 36.

The spacing between the protective bodies 36 is shorter than the front-rear length of the casing 41 of the storage cassette 22. In the second state, damage to the loading section side connector 37 and the positioning pin 38 due to the lower end portion of the storage cassette 22 entering into the right frame upper portion space 32U, namely, due to impact from the storage cassette 22, can be prevented by causing the respective left side faces of the protective bodies 36 to abut the right side face of the storage cassette 22.

Figure 11:
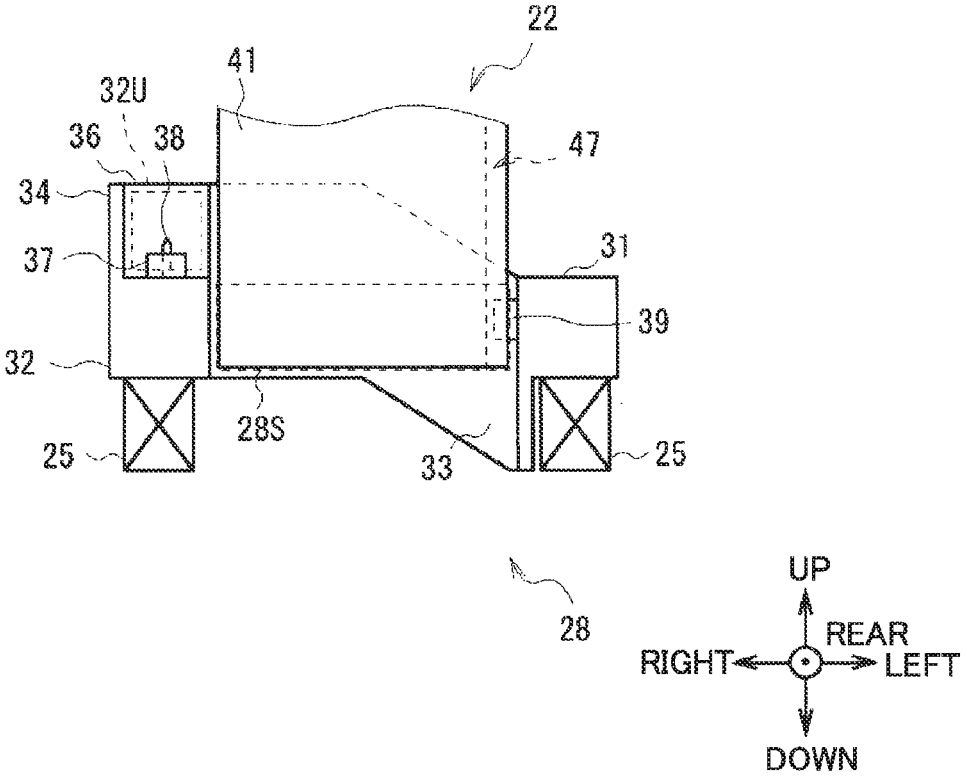
FIG. 11 is a schematic diagram illustrating loading of a storage cassette (third state) in the first exemplary embodiment.
Figure 12:
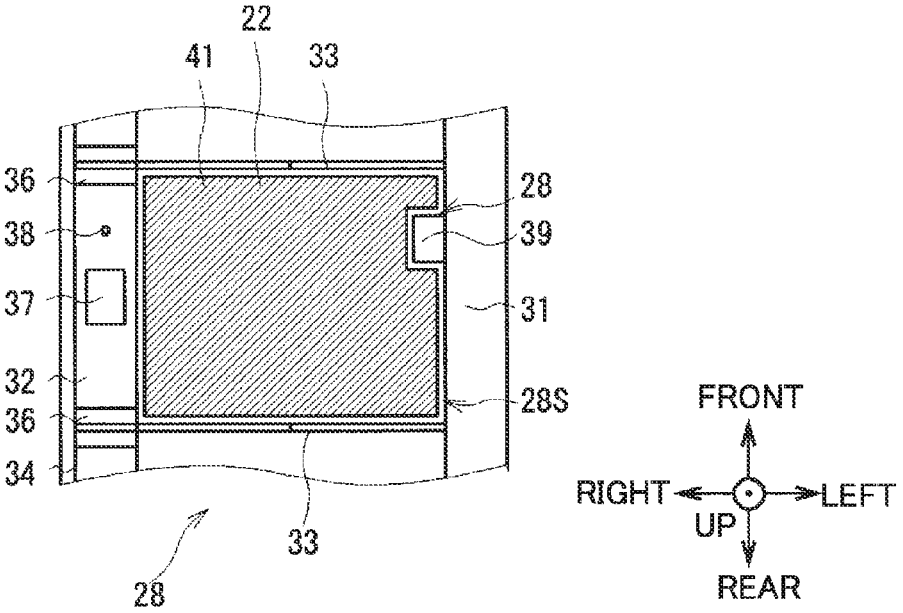
FIG. 12 is a schematic diagram illustrating loading of a storage cassette (third state) in the first exemplary embodiment.

In the second state, when the storage cassette 22 is lowered downward by a technician, as illustrated in FIG. 11 and FIG. 12, the positioning projection 39 is caused to enter into the guide groove 47 of the storage cassette 22. This state is referred to below as the third state. In the third state, the front-rear direction position of the left end of the storage cassette 22 can be aligned to the proper position with respect to the loading section 28 with high precision.

Figure 13:
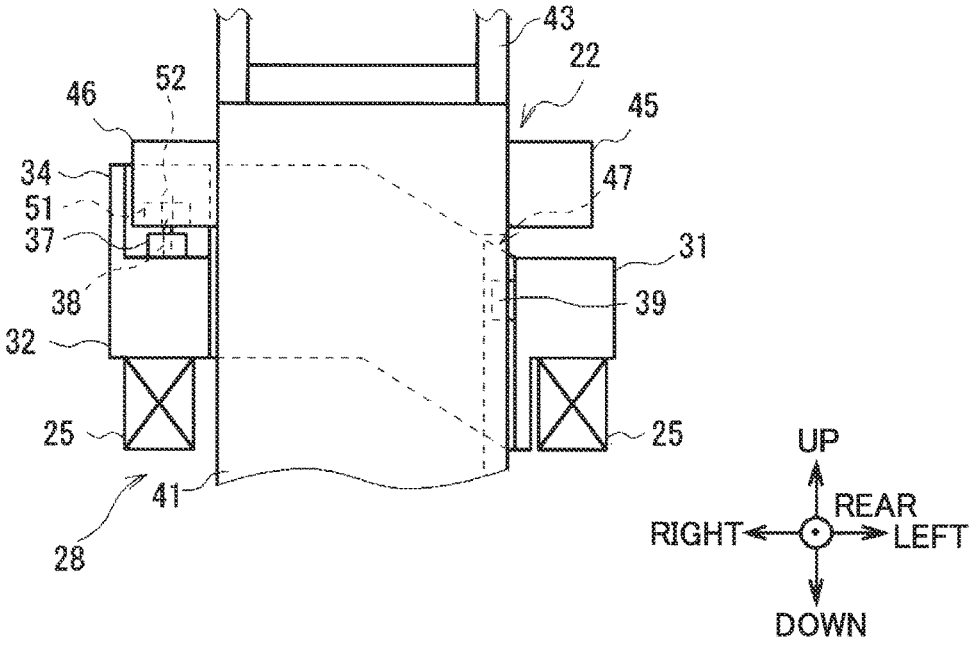
FIG. 13 is a schematic diagram illustrating loading of a storage cassette (fourth state) in the first exemplary embodiment.

In the third state, when the storage cassette 22 is lowered further downward by a technician, as illustrated in FIG. 13, the positioning pin 38 is inserted into the positioning hole 52 of the right protrusion portion 46 of the storage cassette 22. This state is referred to below as the fourth state. In the fourth state, the front-rear direction position of the right end of the storage cassette 22 can be aligned to the proper position with respect to the loading section 28 with high precision. Namely, in the fourth state, the overall left-right direction position, including both left and right ends, of the storage cassette 22 can be aligned to the proper position with high precision.

Figure 14:
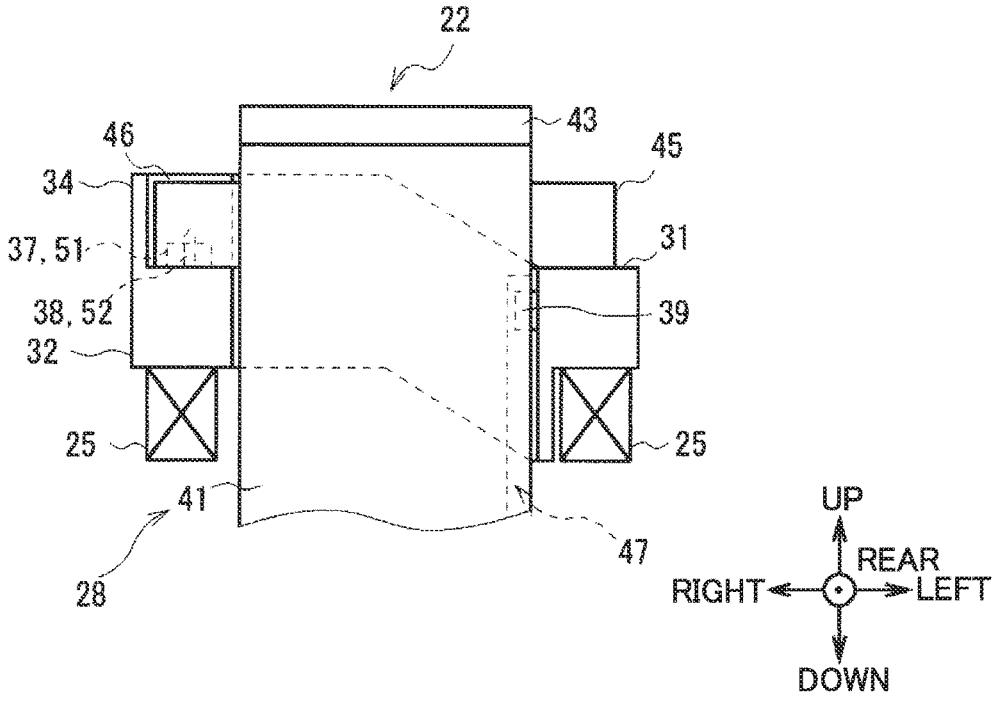
FIG. 14 is a schematic diagram illustrating loading of a storage cassette (loaded state) in the first exemplary embodiment.
Figure 15:
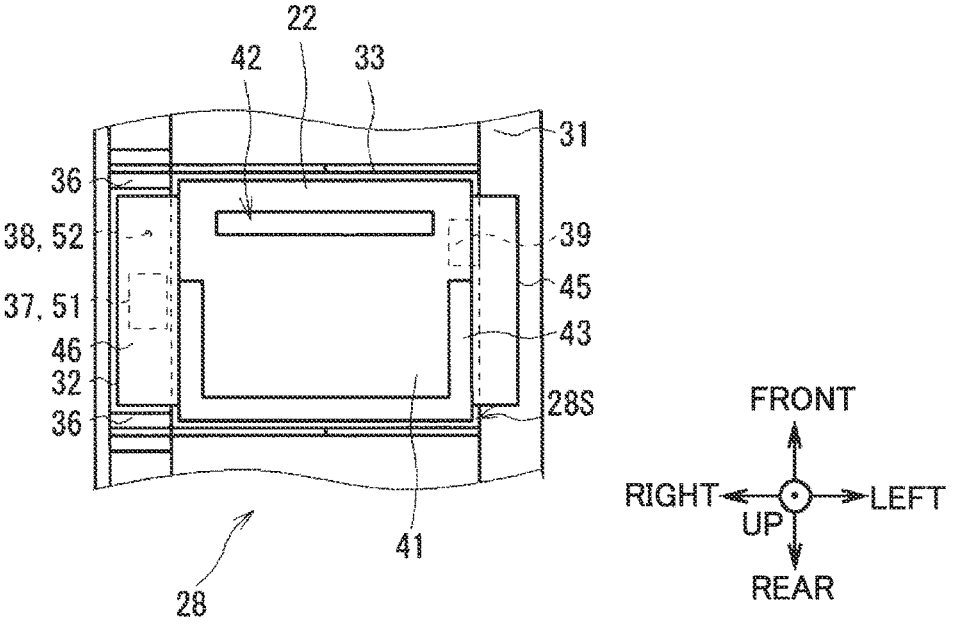
FIG. 15 is a schematic diagram illustrating loading of a storage cassette (loaded state) in the first exemplary embodiment.

In the fourth state, when the storage cassette 22 is lowered further downward by a technician, as illustrated in FIG. 14 and FIG. 15, the cassette side connector 51 of the right protrusion portion 46 of the storage cassette 22 is fitted onto the loading section side connector 37, and the two are electrically connected to each other. Due to abutting the lower faces of the left protrusion portion 45 and the right protrusion portion 46 against the respective upper faces of the left frame 31 and the right frame 32, the storage cassette 22 adopts a state stably supported by the left frame 31 and the right frame 32. This state is referred to below as the loaded state. In this fifth state, the storage cassette 22 is loaded into the loading section 28 oriented at the proper angle and in the proper position.

In the banknote pay-in/pay-out device 10, when the storage cassette 22 is loaded into the loading section 28 in this manner, the storage cassette 22 is loaded in a state aligned to the proper angle and the proper position by going through the steps of the first state to the fourth state to reach the loaded state.

1-6. Operation and Advantageous Effects

In the configuration described above, a portion of the loading section 28 of the banknote pay-in/pay-out device 10 further to the lower side than the slide rails 25 is omitted, and the storage cassette 22 is supported by the left frame 31 and the right frame 32 provided at the upper side of the slide rails 25.

Figure 16:
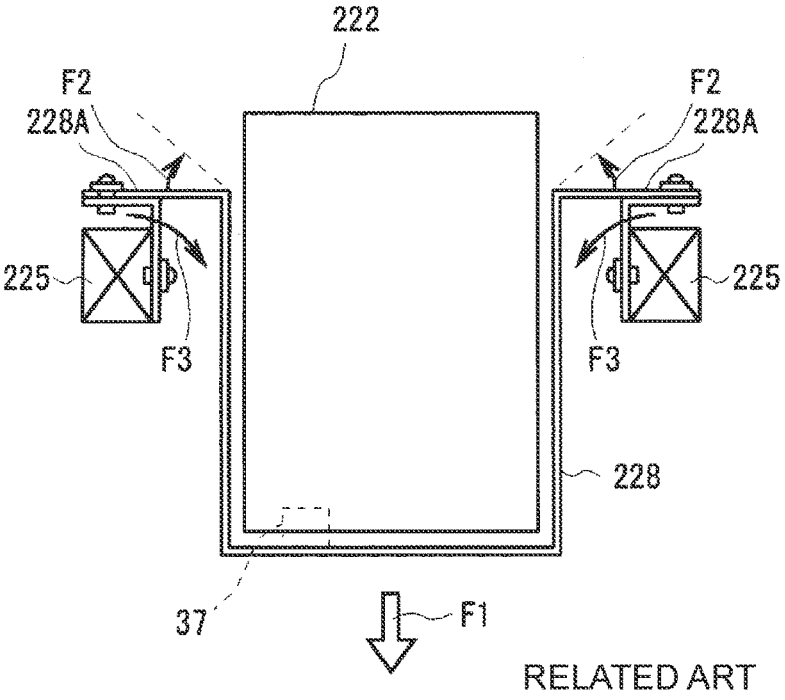
FIG. 16 is a schematic perspective view illustrating configuration of a loading section according to related art.
Figure 17:
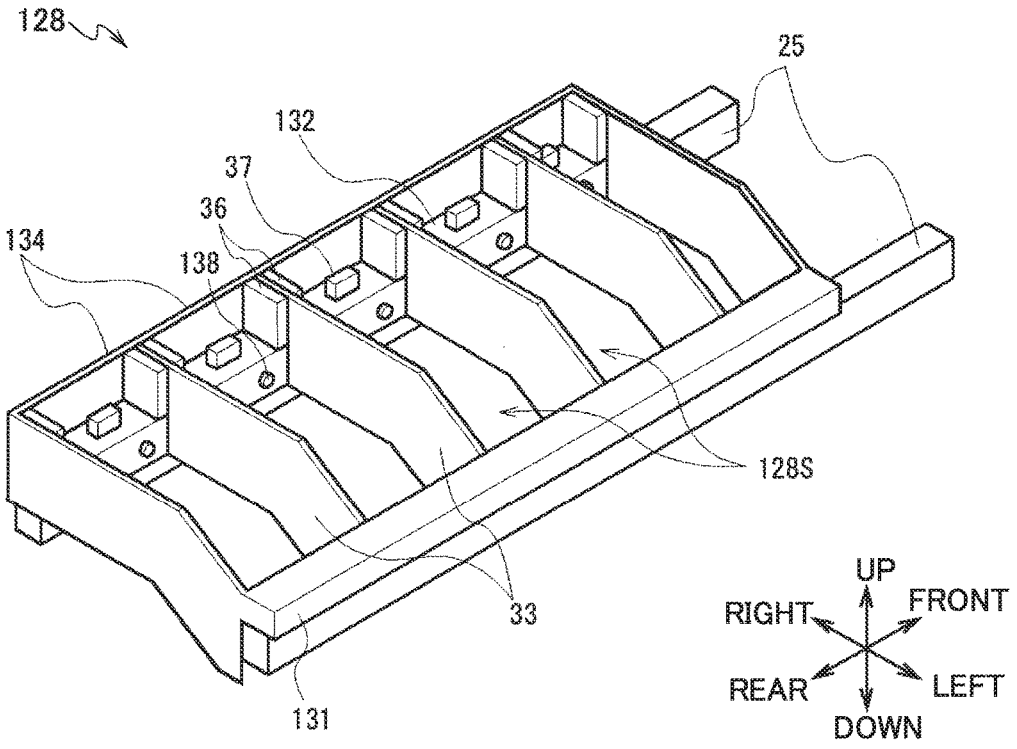
FIG. 17 is a schematic perspective view illustrating configuration of a loading section according to a second exemplary embodiment.

FIG. 16 illustrates a schematic configuration of a banknote pay-in/pay-out device 210 of related art by way of comparison to the banknote pay-in/pay-out device 10. A loading section 128 of the banknote pay-in/pay-out device 210 is formed in a substantially U shape as viewed along the front-rear direction, is configured so as to cover the periphery of the lower side portion of a loaded storage cassette 222 including a bottom face thereof, and is fixed to the slide rails 25 by left and right flange shaped portions 228A.

In the banknote pay-in/pay-out device 210 of related art, the rigidity of members configuring a loading section 228 is sometimes insufficient due to considerations such as weight reduction. Thus, in the banknote pay-in/pay-out device 210 of related art, when a force F1 due to the weight of the storage cassette 222 is applied to a bottom portion of the loading section 228, an upward lifting force F2 acts on the flange shaped portions 228A, and there is accordingly concern of a twisting direction force F3 acting on the slide rails 225. The slide rails 225 of the banknote pay-in/pay-out device 210 therefore require sufficient strength to resist the force F3 in the twisting direction, leading to an increase in size and an increase in costs.

However, in the banknote pay-in/pay-out device 10 according to the present exemplary embodiment, by omitting the portion of the loading section 28 that is further to the lower side than the slide rails 25, the weight of the loading section 28 can be greatly reduced compared to the banknote pay-in/pay-out device 210 of related art. In the banknote pay-in/pay-out device 10, while still obtaining sufficient strength, the weight can be greatly reduced compared to a case in which the left frame 31 and the right frame 32 are configured by solid angular column shapes, due to configuring the left frame 31 and the right frame 32 in hollow angular column shapes.

Moreover, in the banknote pay-in/pay-out device 10, load from the left frame 31 and the right frame 32, which are formed in hollow angular column shapes and have sufficient strength, is applied to the slide rails 25 in a direction substantially directly downward. Thus, the possibility of twisting occurring in the slide rails 25 is exceedingly low, and configuration of the banknote pay-in/pay-out device 10 can be made simpler than hitherto without the slide rails 25 needing to have a strength capable of resisting twisting. In the banknote pay-in/pay-out device 10, the slide rails 25 can accordingly be made more compact than hitherto, and costs are able to be reduced.

Note that at a stage prior to loading in the banknote pay-in/pay-out device 10, the storage cassette 22, gripped by the handle 43 (FIG. 7) by a maintenance technician or the like, can be tilted (rotated) in various directions with respect to the proper angle, and can be offset (moved) along various directions with respect to the proper position.

Moreover, since the loading section side connector 37 of the banknote pay-in/pay-out device 10 cannot be provided at the bottom portion of the loading section 228 as in the related banknote pay-in/pay-out device 210, the loading section side connector 37 is provided at a position that can be easily touched from the outside, such as on the upper face of the right frame 32.

Regarding this point, the upper edges of the right protective plate 34 and the partitioning plates 33 of the loading section 28 are formed so as to be higher than the upper face of the loading section side connector 37 and the positioning pin 38. Accordingly, even if the storage cassette 22 were to be lowered into the banknote pay-in/pay-out device 10 from above the loading section 28 at an orientation differing greatly from the proper position and the proper angle, the lower face of the storage cassette 22 can still be caused to abut the upper ends of the right protective plate 34 and the partitioning plates 33. The storage cassette 22 can thereby be prevented from accidentally damaging the loading section side connector 37 and the positioning pin 38 of the banknote pay-in/pay-out device 10.

The loading section 28 is provided with two protective bodies 36 on the upper face of the right frame 32. The upper faces of the protective bodies 36 are aligned with the upper edges of the right protective plate 34 and the partitioning plates 33 and are positioned higher than the upper face of the loading section side connector 37 and the positioning pin 38. Left side faces of the protective bodies 36 are aligned with the right side face of the right frame 32 and are positioned further to the left side than the upper face of the loading section side connector 37 and the positioning pin 38. In addition, the front-rear direction spacing between the protective bodies 36 of the loading section 28 is narrower than the front-rear length of the casing body 41 of the storage cassette 22. This enables the vicinity of a lower face right end of the storage cassette 22 to be prevented from entering the right frame upper portion space 32U in the banknote pay-in/pay-out device 10. Namely, this enables damage to the loading section side connector 37 and the positioning pin 38 to be prevented Moreover, in the loading section 28, a continuous flat face is formed by substantially aligning the left side faces of the protective bodies 36 to the left side face of the right frame 32. When transitioning from the second state (FIG. 10) to the third state (FIG. 11), sliding the right side face of the storage cassette 22 continuously against the protective bodies 36 and the left side face of the right frame 32 enables the storage cassette 22 to be lowered smoothly into the banknote pay-in/pay-out device 10.

In addition, out of the front, rear, left, and right side faces of the loading section 28, the front, rear, and right side faces are higher than the upper face of the right frame 32, whereas only the left side face is lower than the other side faces, namely, the left side face is configured so as not to protrude out whatsoever from the upper face of the left frame 31.

Thus, in the banknote pay-in/pay-out device 10, even when the orientation of the storage cassette 22 is not aligned at the proper angle, the vicinity of the lower end of the storage cassette 22 can be caused to enter between the partitioning plates 33 by moving the storage cassette 22 from an upper left side of the loading section 28 toward the right, and correcting the angle of front and rear side faces of the casing body 41 so as to slide the storage cassette 22 against the surfaces of the partitioning plates 33 when this is being performed.

Namely, in the banknote pay-in/pay-out device 10, since there is no need for the position and the angle of the storage cassette 22 to be made to approach the proper position and the proper angle at the same time, it is easier for a maintenance technician or the like to transition to the first state (FIG. 9) than in cases in which there is a protective plate corresponding to the right protective plate 34 provided on the left side. In addition, the height to which the storage cassette 22 is lifted off of the floor into the banknote pay-in/pay-out device 10 can be suppressed to be relatively lower.

The loading section 28 is provided with the positioning projection 39 on the left side, this being an opposite side of the loading hole 28S to the loading section side connector 37 and the positioning pin 38 (FIG. 6A to FIG. 6C). This enables the front-rear direction position of the storage cassette 22, particularly in the vicinity of the left side face of the storage cassette 22, to be aligned to the proper position in the banknote pay-in/pay-out device 10 with high precision.

Moreover, the positioning pin 38 is disposed in the vicinity of the loading section side connector 37 on the upper face of the right frame 32 of the loading section 28, and the upper end of the positioning pin 38 protrudes out to a position higher than the upper face of the loading section side connector 37 (FIG. 6A to FIG. 6C). This enables the positioning pin 38 to be inserted into the positioning hole 52 and the front-rear direction position and the left-right direction position of the storage cassette 22 to be aligned with the loading section 28 with high precision (the fourth state), and then the cassette side connector 51 to be properly fitted onto the loading section side connector 37 (the fifth state) when loading the storage cassette 22 into the loading section 28 in the banknote pay-in/pay-out device 10. This enables issues such as poor fitting or poor contact due to positional misalignment between the cassette side connector 51 and the loading section side connector 37, or damage to the respective connectors, for example, to be preemptively prevented in the banknote pay-in/pay-out device 10.

The storage cassette 22 is supported due to the left protrusion portion 45 and the right protrusion portion 46 provided at positions near the upper end of the storage cassette 22 abutting the upper faces of the respective left frame 31 and the right frame 32 of the loading section 28. Accordingly, in the banknote pay-in/pay-out device 10, the center of gravity of the storage cassette 22, which is positioned substantially at the up-down direction center of the storage cassette 22, can be supported on both the left and right sides, at a location higher than the center of gravity such that the center of gravity is suspended, thereby enabling the orientation of the storage cassette 22 to be stabilized without swaying or the like occurring.

Moreover, the front-rear direction position of the storage cassette 22 is set by the positioning pin 38 and the positioning projection 39 at a location comparatively close to the insertion hole 42 provided on the upper face of the storage cassette 22. The front-rear direction positions of the positioning hole 52 and the guide groove 47 corresponding to the respective positioning pin 38 and the positioning projection 39 are aligned with the insertion hole 42 of the storage cassette 22 (FIG. 8A). This enables the front-rear direction position of the insertion hole 42 to be aligned with respect to the hand-over port 27A with high precision, thereby enabling banknotes to be stably passed between the storage cassette 22 and the lower conveyance section 21 in the closed state in which the lid body 27 (FIG. 4) has been closed (FIG. 2).

Moreover, in the loading section 28, the positioning projection 39 is only provided on the left frame 31, and the guide groove 47 is only formed on the left side face of the storage cassette 22. Thus, in the banknote pay-in/pay-out device 10, although the storage cassette 22 could be loaded into the loading section 28 oriented incorrectly along the front-rear direction due to the storage cassette 22 being formed in a rectangular block shape, when in the incorrect orientation, incorrect insertion can be prevented by interaction between the positioning projection 39 and the casing body 41 of the storage cassette 22.

In the above configuration, the portion of the banknote pay-in/pay-out device 10 of the ATM 1 according to the first exemplary embodiment further to the lower side than the slide rails 25 is omitted and the storage cassette 22 is supported by the left frame 31 and the right frame 32 provided at the upper side of the slide rails 25. This enables the weight of the loading section 28 to be greatly reduced, and enables the slide rails 25 to be made more compact than hitherto. The upper edges of the right protective plate 34 and the partitioning plates 33 of the banknote pay-in/pay-out device 10 are also formed so as to be higher than the upper face of the loading section side connector 37 and the positioning pin 38, enabling damage to the upper face of the loading section side connector 37 and the positioning pin 38 caused by abutting with the storage cassette 22 and the like to be preemptively prevented.

2. Second Exemplary Embodiment

An ATM 101 (FIG. 1) according to a second exemplary embodiment differs from the ATM 1 according to the first exemplary embodiment in the point that a banknote pay-in/pay-out device 110 is provided in place of the banknote pay-in/pay-out device 10, while being similarly configured in other respects.

2-1 Configuration of Banknote Pay-In/Pay-Out Device

The banknote pay-in/pay-out device 110 differs from the banknote pay-in/pay-out device 10 according to the first exemplary embodiment in the point that a lower section unit 113 and storage cassettes 122 are provided in place of the lower section unit 13 and the storage cassettes 22, while being similarly configured in other respects.

The lower section unit 113 differs from the lower section unit 13 according to the first exemplary embodiment in the point that a loading section 128 is provided in place of the loading section 28, while being similarly configured in other respects. As illustrated in FIG. 17 and FIG. 18A to FIG. 18C corresponding to FIG. 5 and FIG. 6A to FIG. 6C respectively, the loading section 128 includes a left frame 131 and a right frame 132 in place of the left frame 31 and the right frame 32.

Figure 18A:
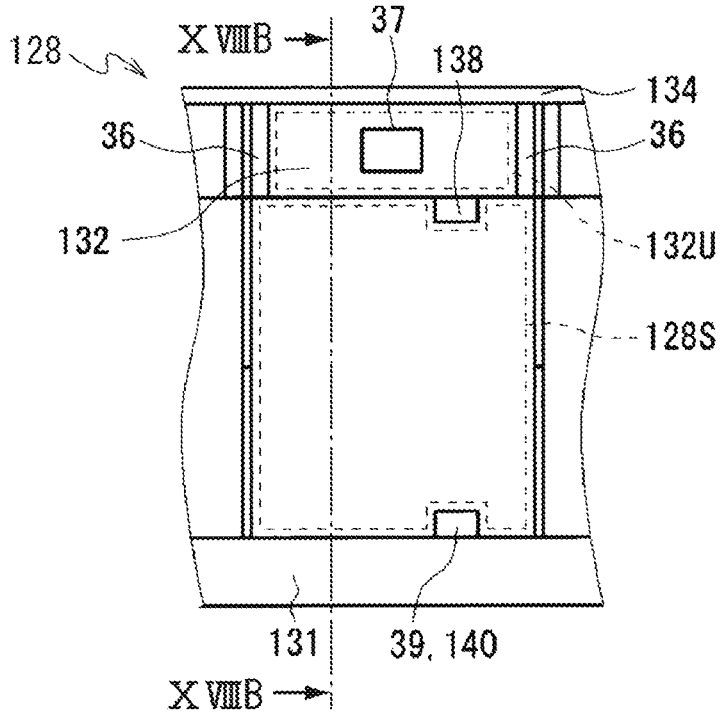
FIG. 18A is a schematic diagram illustrating configuration of a loading section according to the second exemplary embodiment.
Figure 18B:
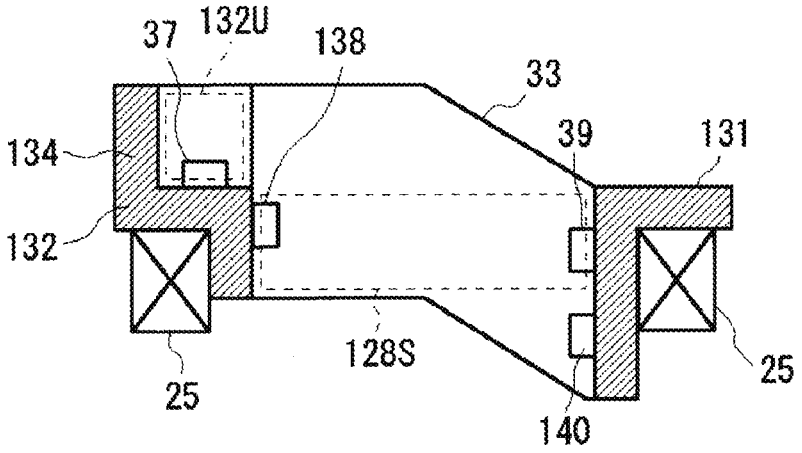
FIG. 18B is a schematic diagram illustrating configuration of a loading section according to the second exemplary embodiment.

The left frame 131 is formed in a shape that is long in the front-rear direction similarly to in the first exemplary embodiment; however, in contrast to the first exemplary embodiment, a thick metal member is bent so as to form the left frame 131 in substantially an L shape, as illustrated in FIG. 18B, in a cross-section taken along XVIIIB-XVIIIB in FIG. 18A. Moreover, the right frame 132 is formed in a shape that is long in the front-rear direction similarly to in the first exemplary embodiment; however, the shape of the right frame 132 is formed such that a cross-section of the right frame 132 is bent in substantially an S shape or a crank shape, and forms a right protective plate 134 with a portion extending upward at a right side of the right frame 132.

The loading section 128 differs from the first exemplary embodiment in the point that the positioning pin 38 is omitted, and positioning projections 138 and 140 projecting out toward a loading hole 128S are provided.

Figure 18C:
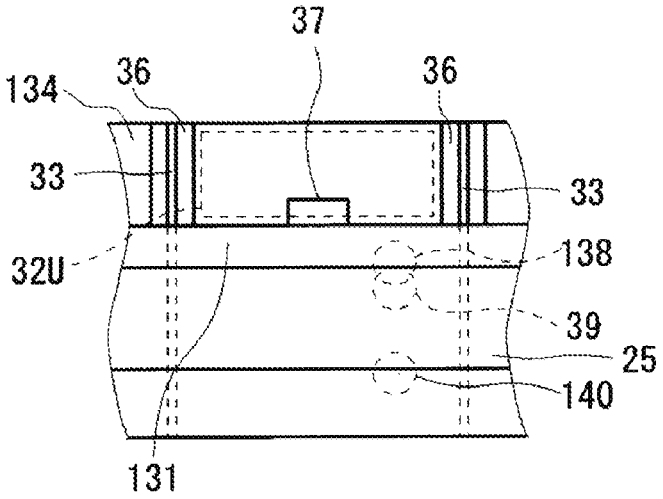
FIG. 18C is a schematic diagram illustrating configuration of a loading section according to the second exemplary embodiment.
Figure 19:
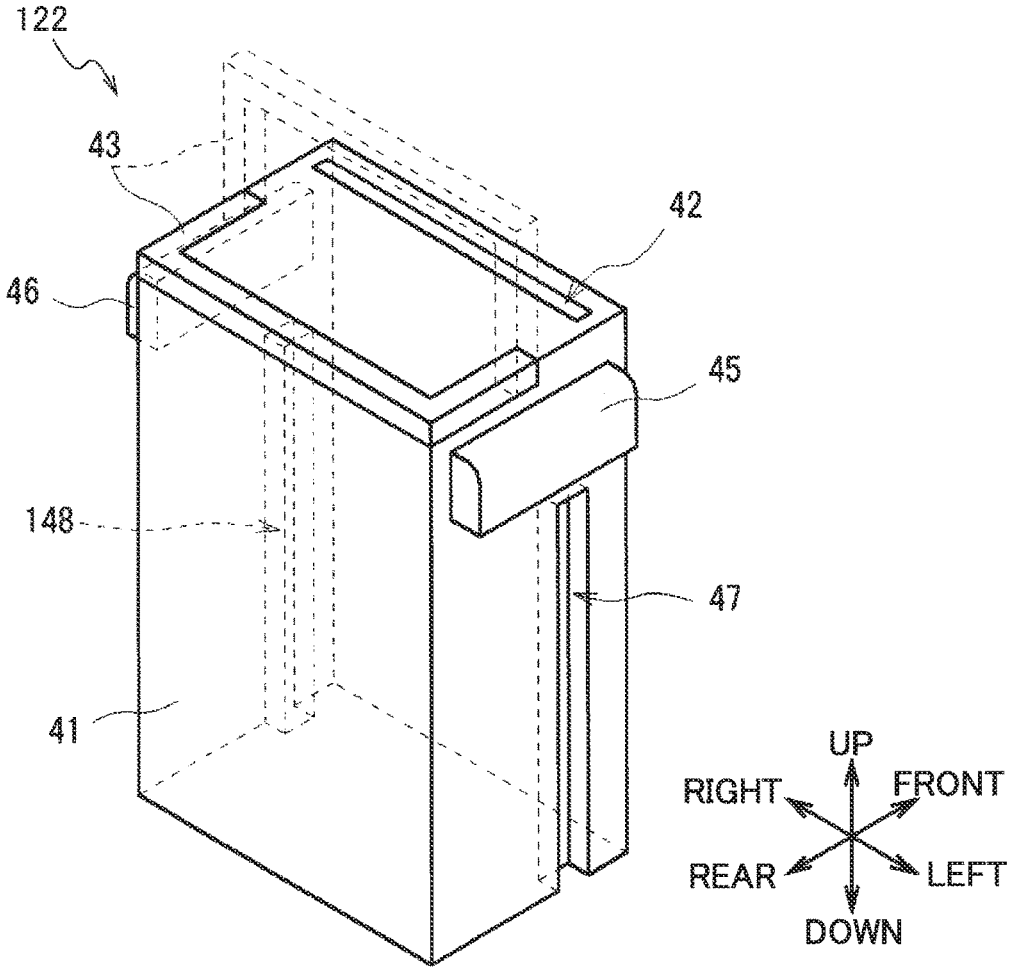
FIG. 19 is schematic perspective view illustrating configuration of a storage cassette according to the second exemplary embodiment.
Figure 20A:
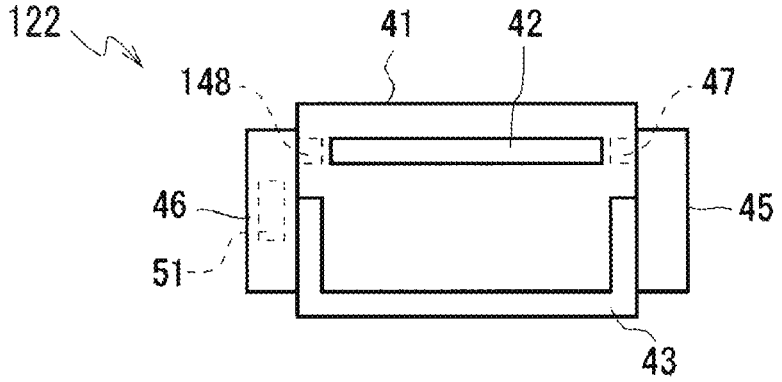
FIG. 20A is a schematic diagram illustrating configuration of a storage cassette according to the second exemplary embodiment.
Figure 20B:
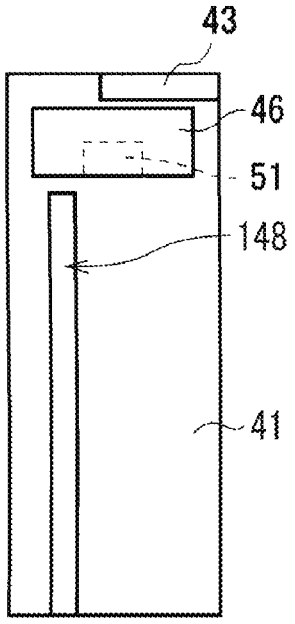
FIG. 20B is a schematic diagram illustrating configuration of a storage cassette according to the second exemplary embodiment.
Figure 20C:
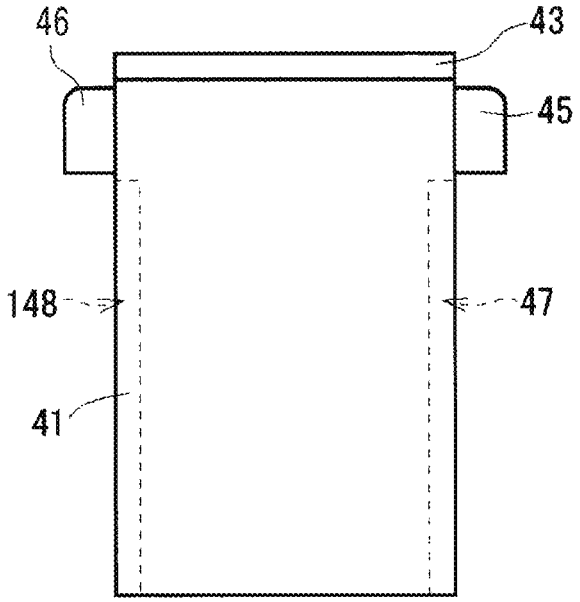
FIG. 20C is a schematic diagram illustrating configuration of a storage cassette according to the second exemplary embodiment.
Figure 20D:
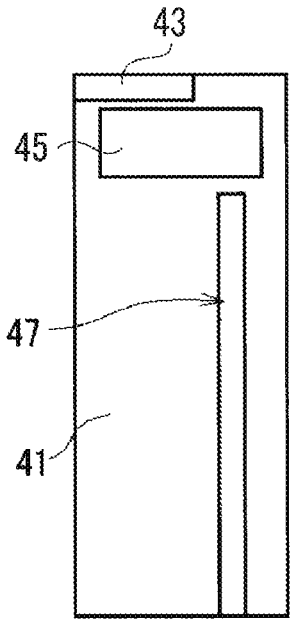
FIG. 20D is a schematic diagram illustrating configuration of a storage cassette according to the second exemplary embodiment.
Figure 20E:
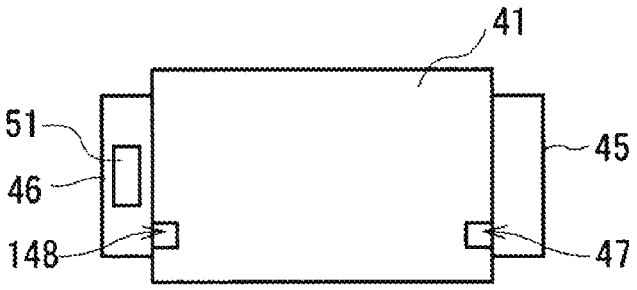
FIG. 20E is a schematic diagram illustrating configuration of a storage cassette according to the second exemplary embodiment.

The positioning projection 138 is provided on a left side face of the right frame 132, and similarly to the positioning projection 39, is formed in a circular column shape with its axis along the left-right direction and with a comparatively short left-right direction length. The front-rear direction position of the positioning projection 138 is substantially in-phase with that of the left side positioning projection 39 (FIG. 18A and FIG. 18C). The up-down direction position of the positioning projection 138 is slightly higher than the positioning projection 39 (FIG. 18B and FIG. 18C).

The positioning projection 140 is provided at a lower side of the positioning projection 39 on a right side face of the left frame 131. Similarly to the positioning projection 39, the positioning projection 140 is formed in a circular column shape with its axis along the left-right direction, and with a short left-right direction length.

As illustrated in FIG. 19 and FIG. 20A to FIG. 20E corresponding to FIG. 7 and FIG. 8A to FIG. 8E, the storage cassette 122 differs from the storage cassette 22 of the first exemplary embodiment in the point that a guide groove 148 is provided on a right side face and the positioning hole 52 is omitted, while being similarly configured in other respects. The guide groove 148 is configured with substantially left-right symmetry with respect to the guide groove 47. Namely, a front-rear direction position of the guide groove 148 is substantially aligned with the insertion hole 42 and the guide groove 47.

2-2 Loading Operation of the Storage Cassettes into the Loading Section

Next, explanation follows regarding a loading operation in which the storage cassette 122 is loaded into the loading hole 128S of the loading section 128 of the banknote pay-in/pay-out device 110 while alluding to the first exemplary embodiment, explained in stages by splitting up into a number of steps.

In the banknote pay-in/pay-out device 110, the storage cassette 122 is lifted off of the floor and the vicinity of a lower end of the storage cassette 122 is inserted between the partitioning plates 33 of the loading section 128 by a maintenance technician or the like, and a right end of the storage cassette 122 is caused to abut the respective protective bodies 36 to adopt a first state and a second state, similar to in the first exemplary embodiment (FIG. 9 and FIG. 10).

Figure 21:
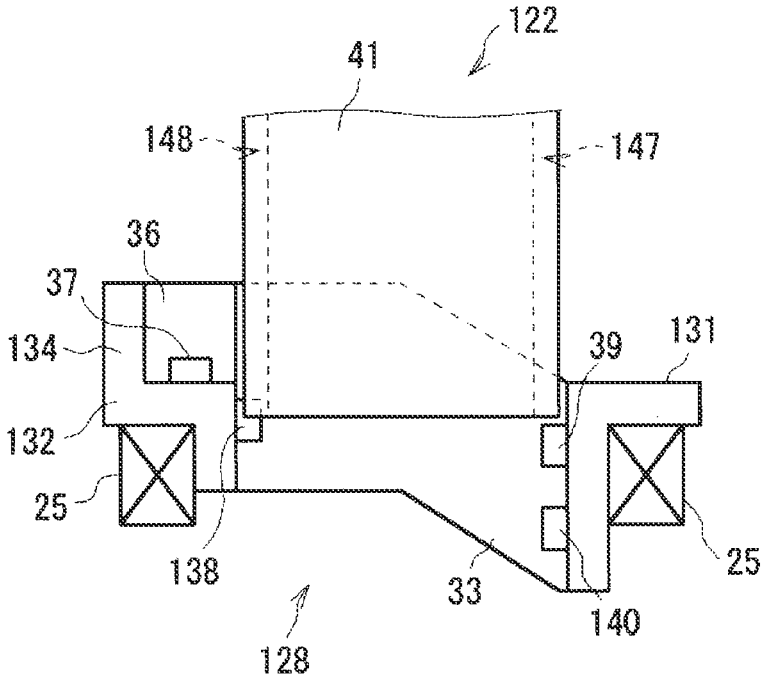
FIG. 21 is a schematic diagram illustrating loading of a storage cassette (third state) in the second exemplary embodiment.

In the second state, when a maintenance technician or the like lowers the storage cassette 122 downward, as illustrated in FIG. 21, the positioning projection 138 is inserted inside the guide groove 148 of the storage cassette 122. This state is referred to as the third state below. In the third state, a front-rear direction position of the right end of the storage cassette 122 can be aligned to the proper position with respect to the loading section 128 with high precision.

Figure 22:
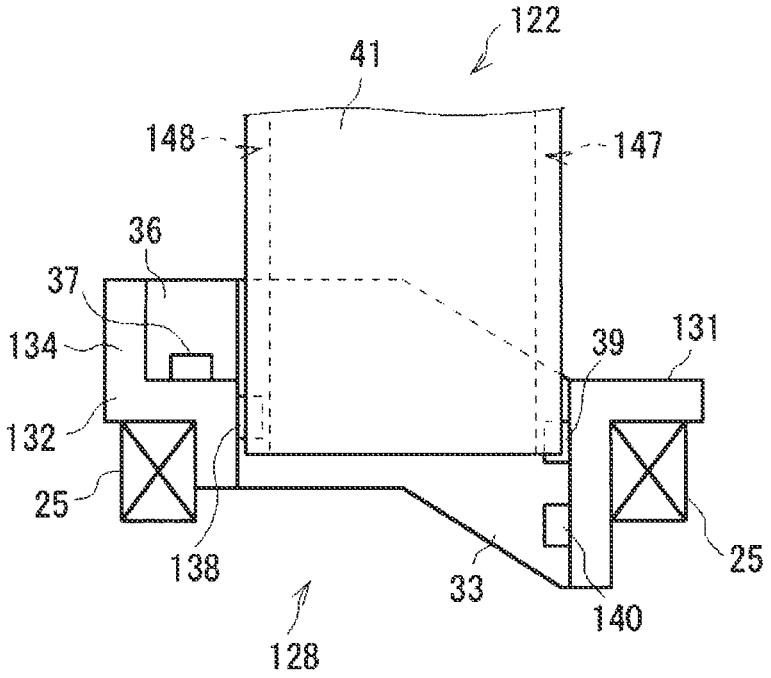
FIG. 22 is a schematic diagram illustrating loading of a storage cassette (fourth state) in the second exemplary embodiment.
Figure 23:
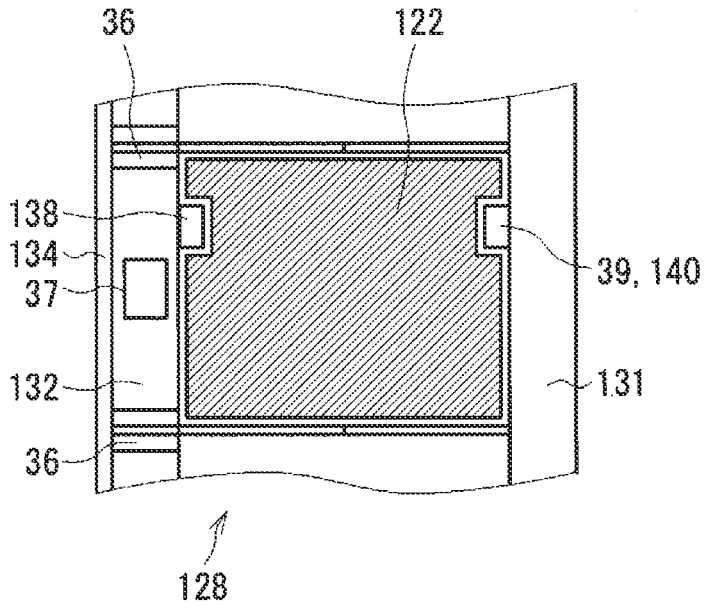
FIG. 23 is a schematic diagram illustrating loading of a storage cassette (fourth state) in the second exemplary embodiment.

In the third state, when a maintenance technician or the like lowers the storage cassette 122 further downward, as illustrated in FIG. 22 and FIG. 23, the positioning projection 39 is caused to enter the guide groove 47 of the storage cassette 122. This state is referred to below as the fourth state. In the fourth state, the front-rear direction position of a left end of the storage cassette 122 can be aligned to the proper position with respect to the loading section 128 with high precision. Namely, in the fourth state, the overall front-rear direction position, including both left and right ends, of the storage cassette 122 can be aligned to the proper position with high precision.

Figure 24:
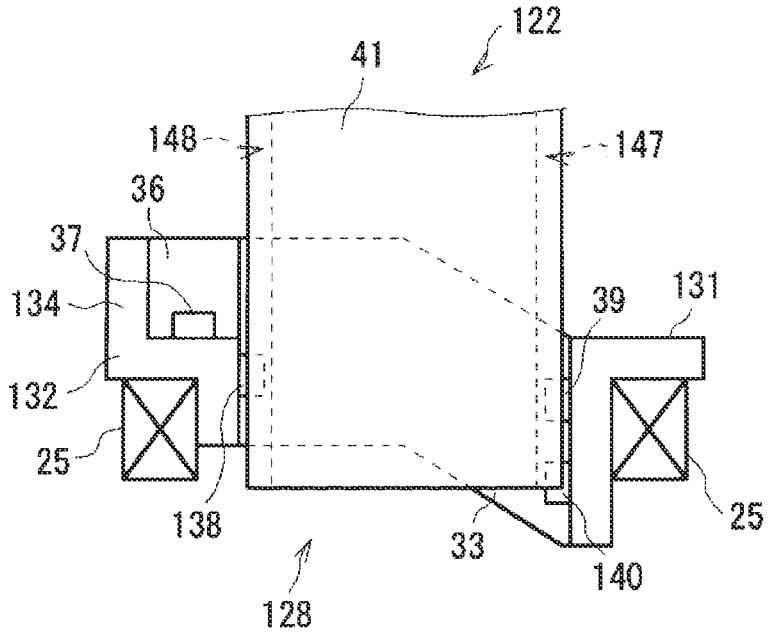
FIG. 24 is a schematic diagram illustrating loading of a storage cassette (fifth state) in the second exemplary embodiment.

In the fourth state, when the technician or the like lowers the storage cassette 122 further downward, as illustrated in FIG. 24, the positioning projection 140 is caused to enter the guide groove 47 of the storage cassette 122. This state is referred to as the fifth state below. In the fifth state, front-rear direction positions at two locations on the left face of the storage cassette 122 separated from each other in the up-down direction are respectively set, such that an angle of inclination of the storage cassette 122 along the front-rear direction is substantially aligned to the proper angle with respect to the loading section 128.

In the fifth state, when a maintenance technician or the like lowers the storage cassette 122 further downward, the cassette side connector 51 of the right protrusion portion 46 of the storage cassette 122 is fitted onto the loading section side connector 37 and the cassette side connector 51 and the loading section side connector 37 are electrically connected to each other, similarly to in the case of the first exemplary embodiment as illustrated in FIG. 14 and FIG. 15. Due to causing the lower faces of the left protrusion portion 45 and the right protrusion portion 46 to abut the respective upper faces of the left frame 131 and the right frame 132, such that the storage cassette 122 adopts a loaded state stably supported by the left frame 131 and the right frame 132.

Thus, in the banknote pay-in/pay-out device 110, when the storage cassette 122 is loaded into the loading section 128, the storage cassette 122 is loaded in a state aligned to the proper angle and the proper position by going through the steps of the first state to the fifth state to reach the loaded state.

2-3 Operation and Advantageous Effects

In the above configuration, the portion of the loading section 128 of the banknote pay-in/pay-out device 110 further to the lower side than the slide rails 25 is omitted, and the storage cassette 122 is supported by the left frame 131 and the right frame 132 provided at the upper side of the slide rails 25. Similarly to in the first exemplary embodiment, the weight of the loading section 128 of the banknote pay-in/pay-out device 110 can be greatly reduced, and the slide rails 25 can be made more compact and a reduction in costs can be achieved compared to the banknote pay-in/pay-out device 210 of related art (FIG. 16).

Moreover, in the loading section 128, the positioning projection 138 is provided on the left side face of the right frame 132, and the positioning projections 39 and 140 are provided on the right side face of the left frame 131 (FIG. 18A to FIG. 18C). Corresponding thereto, the guide grooves 47 and 148 are formed in both left and right side faces of the storage cassette 122 aligned with the front-rear position of the insertion hole 42 (FIG. 19 and FIG. 20A to FIG. 20E).

In the banknote pay-in/pay-out device 110, the front-rear direction position of the storage cassette 122 is thereby aligned to the proper position with respect the loading section 128 with good precision by going through the third state (FIG. 21) to reach the fourth state (FIG. 22 and FIG. 23). Moreover, in the banknote pay-in/pay-out device 110, the angle of inclination of the storage cassette 122 in the front-rear direction can be aligned to the proper angle by inserting both the positioning projections 39 and 140 into the guide groove 47 in the fifth state (FIG. 24).

In the process of transitioning to the loaded state of the banknote pay-in/pay-out device 110 (FIG. 14 and FIG. 15), the cassette side connector 51 can thereby be brought close to and suitably fitted onto the loading section side connector 37 in a state in which positional misalignment from substantially directly above is suppressed to a minimum.

The banknote pay-in/pay-out device 110 exhibits similar operation and advantageous effects to that of the banknote pay-in/pay-out device 10 according to the first exemplary embodiment in other respects.

In the above configuration, the portion of the banknote pay-in/pay-out device 110 of the ATM 101 according to the second exemplary embodiment further to the lower side than the slide rails 25 is omitted, and the storage cassette 122 is supported by the left frame 131 and the right frame 132 provided at the upper side of the slide rails 25. This enables the weight of the loading section 128 to be greatly reduced, and enables the slide rails 25 to be made more compact.

3. Other Exemplary Embodiments

Note that in the exemplary embodiments described above, explanation has been given regarding a case in which the right protective plate 34 and the protective bodies 36 are disposed above the upper face of the right frame 32, and the upper edges of the partitioning plates 33 are aligned to the same height as the upper edge of the right protective plate 34, and these upper edges are higher than the upper ends of the upper face of the loading section side connector 37 and the positioning pin 38. However, the present disclosure is not limited thereto. For example, configuration may be made in which at least one out of a portion of the partitioning plates 33 at the upper side of the right frame 32, the right protective plate 34, or the protective bodies 36 remains while the others are omitted. The upper edges of the partitioning plates 33, and the upper edge portion of the right protective plate 34 also do not necessarily need to be straight line shapes, and the respective portions may be different heights to each other. Moreover, the height of the partitioning plates 33, the right protective plate 34, and the protective bodies 36 do not necessarily need to be in alignment, as long as the heights of the partitioning plates 33, the right protective plate 34, and the protective bodies 36 are at least higher than the upper face of the loading section side connector 37 and the upper end of the positioning pin 38. Similar also applies to the second exemplary embodiment.

In the first exemplary embodiment described above, explanation has been given regarding a case in which the left side faces of the protective bodies 36 and the left side faces of the right frame 32 together form a continuous flat face. However, the present disclosure is not limited thereto, and the left side faces of the two may be non-continuous, such as in a configuration in which the left side faces of the protective bodies 36 protrude out further toward the left side (namely, toward the loading hole 28S inside) than the left side face of the right frame 32. The left side faces of the protective bodies 36 may be formed as faces of various shapes other than flat faces along the up-down direction, this being the direction in which the storage cassette 22 is loaded, such as inclined faces or curved faces. Similar also applies to the second exemplary embodiment.

In the first exemplary embodiment described above, explanation has been given regarding a case in which the loading section side connector 37 is provided on the upper face of the right frame 32. However, the present disclosure is not limited thereto, and for example, the loading section side connector 37 may be provided inside the right frame 32, and a hole may be provided in an upper side portion of the right frame 32.

In the first exemplary embodiment described above, explanation has been given regarding a case in which front-rear direction positions of the insertion hole 42, the guide groove 47, and the positioning hole 52 of the storage cassette 22 are aligned with each other. However, the present disclosure is not limited thereto, and the front-rear direction positions of the insertion hole 42, the guide groove 47, and the positioning hole 52 may be different to each other. Moreover, the guide groove 47, the positioning projection 39, the positioning pin 38, and the positioning hole 52 may be omitted in cases in which, for example, a gap between the loading hole 28S and the casing body 41 of the storage cassette 22 is comparatively narrow such that storage cassette 22 is substantially in the proper position just by loading the storage cassette 22 into the loading hole 28S. Similar also applies to the second exemplary embodiment.

In the first exemplary embodiment described above, explanation has been given regarding a case in which one positioning pin 38 is provided in the vicinity of the loading section side connector 37 of the respective individual loading range 28N. However, the present disclosure is not limited thereto, and for example, two or more positioning pins may be provided at various locations in the vicinity of the loading section side connector 37 of the respective individual loading range 28N.

In the first exemplary embodiment described above, explanation has been given regarding a case in which the small, rectangular block shaped left protrusion portion 45 and right protrusion portion 46 are provided on both the left and right side faces of the storage cassette 22, and, due to the lower faces of the left protrusion portion 45 and the right protrusion portion 46 being caused to abut the respective upper faces of the left frame 31 and the right frame 32, the load of the storage cassette 22 in the loaded state (FIG. 14 and FIG. 15) is supported. However, the present disclosure is not limited thereto. For example, the left protrusion portion 45 may be omitted, and, moreover, in such cases, for example, part of the load of the storage cassette 22 may be supported by the positioning projection 39 by making a ceiling face of the guide groove 47 abut the positioning projection 39. The shapes of the left protrusion portion 45 and the right protrusion portion 46 are not limited to rectangular block shapes, and may, for example, be various three dimensional shapes such as triangular column shapes with their axes along the front-rear direction. That is to say, in such cases, the load of the storage cassette 22 can be supported as long as the lower face of the storage cassette 22 is caused to abut the upper faces of the left frame 31 and the right frame 32 in the loaded state. Similar also applies to the second exemplary embodiment.

Figure 25A:
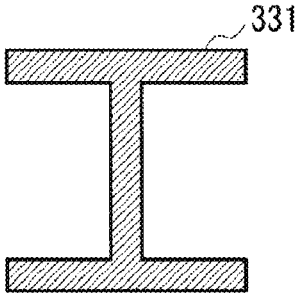
FIG. 25A is a schematic diagram illustrating a cross-section shape of a frame according to another exemplary embodiment.
Figure 25B:
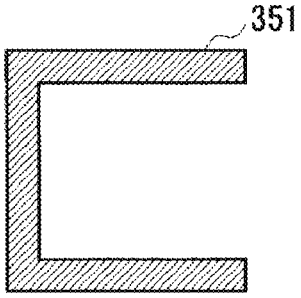
FIG. 25B is a schematic diagram illustrating a cross-section shape of a frame according to another exemplary embodiment.
Figure 25C:
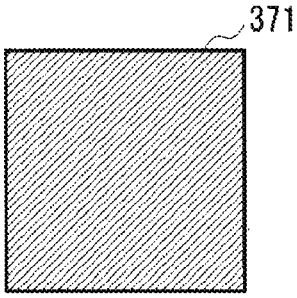
FIG. 25C is a schematic diagram illustrating a cross-section shape of a frame according to another exemplary embodiment.

Moreover, explanation has been given regarding cases in which the left frame 31 and the right frame 32 are configured by hollow angular column shapes (FIG. 6A to FIG. 6C) in the first exemplary embodiment, and the left frame 131 and the right frame 132 are configured by shapes formed by bending thick metal plates (FIG. 18A to FIG. 18C) in the second exemplary embodiment. However, the present disclosure is not limited thereto, and the left frame and the right frame may be various other shapes. For example, as in frames 331, 351, and 371 illustrated in FIG. 25A to FIG. 25C, the left frame and the right frame may be configured having H-shaped or C-shaped cross-sections, or moreover, may have a solid angular column shape. It is sufficient so long as sufficient strength can be secured, while suppressing weight to a comparatively light weight.

In the first exemplary embodiment described above, explanation has been given regarding a case in which the interval in the front-rear direction between the partitioning plates 33 of the loading section 28 furthest to the front side is narrower than the intervals at other locations. However, the present disclosure is not limited thereto. For example, intervals at any two locations may be narrower than at other locations, intervals may be wider at some locations than at other locations, or all of the intervals may be arranged uniformly. Moreover, the number of partitioning plates 33 provided to the loading sections 28 may be modified as appropriate according to the number of storage cassettes 22, reject cassette 23, and the like to be loaded. Similar also applies to the second exemplary embodiment.

Figure 26:
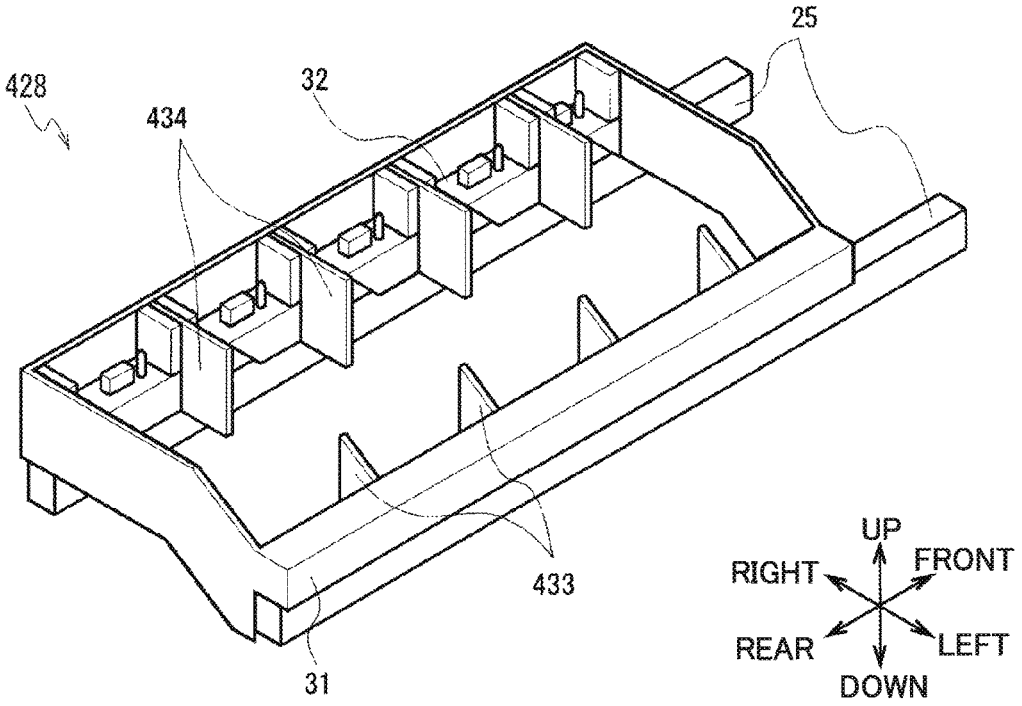
FIG. 26 is a schematic diagram illustrating configuration of a partitioning plate according to another exemplary embodiment.

In the first exemplary embodiment described above, explanation has been given regarding a case in which the partitioning plates 33 that partition the individual loading ranges 28N from each other are single plate shaped members that are long in the left-right direction, and attach to the left frame 31 and the right frame 32 so as to connect the left frame 31 and the right frame 32 together (FIG. 5, FIG. 6A to FIG. 6C). However, the present disclosure is not limited thereto. For example, as in a loading section 428 illustrated in FIG. 26, except for at both front and rear ends thereof, partitioning plates 433, 434, these being two plate shaped members that are short in the left-right direction, may be respectively attached to the left frame 31 and the right frame 32 so as to be separated from each other. Alternatively, the partitioning plates 33 may be omitted from the loading section 28 except for at both front and rear ends thereof. In such cases, it is sufficient so long as the loading positions of the storage cassettes 22 can be set, for example, by positioning projections similar to the positioning projections 138 of the second exemplary embodiment (FIG. 17 and FIG. 18A to FIG. 18C). Similar also applies to the second exemplary embodiment.

In the first exemplary embodiment described above, explanation has been given regarding a case in which a wiring member for connecting to the loading section side connector 37 is inserted inside the right frame 32. However, the present disclosure is not limited thereto, and the wiring member may be disposed at various locations, such as laid out along the left side face or the lower side face of the right frame 32.

Figure 27A:
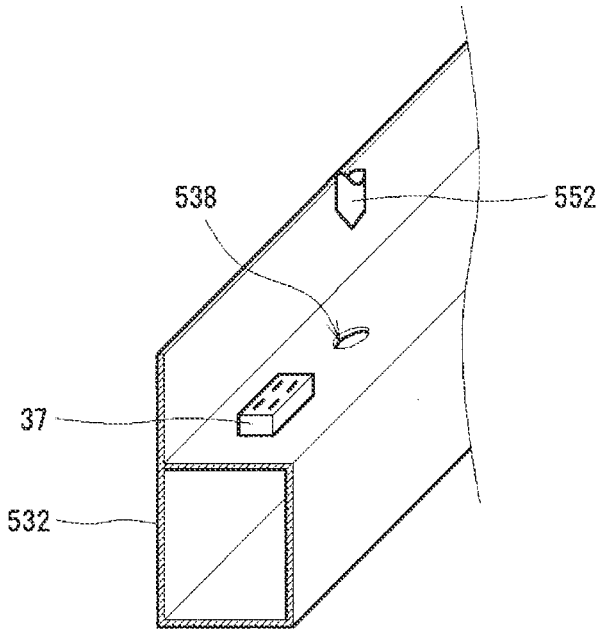
FIG. 27A is a schematic diagram illustrating positioning of a storage cassette with respect to a loading section according to another exemplary embodiment.

In the first exemplary embodiment described above, explanation has been given regarding a case in which the positioning pin 38 is provided on the upper face of the right frame 32 (FIG. 5 and FIG. 6A to FIG. 6C), and the positioning hole 52 is provided in the lower face of the right protrusion portion 46 of the storage cassette 22 (FIG. 8A to FIG. 8E). However, the present disclosure is not limited thereto. For example, as illustrated in FIG. 27A, a positioning hole 538 may be provided in the upper face of a right frame 532, and a positioning pin 552 may be provided on a lower face of the right protrusion portion 46 of the storage cassette 22. In such cases, due to the length of the positioning pin 552 being greater than the height of the loading section side connector 37, the loading section side connector 37 can be fitted onto the cassette side connector 51 in a state in which the front-rear direction and left-right direction positions have been aligned by the positioning pin 552 and the positioning hole 538.

Figure 27B:
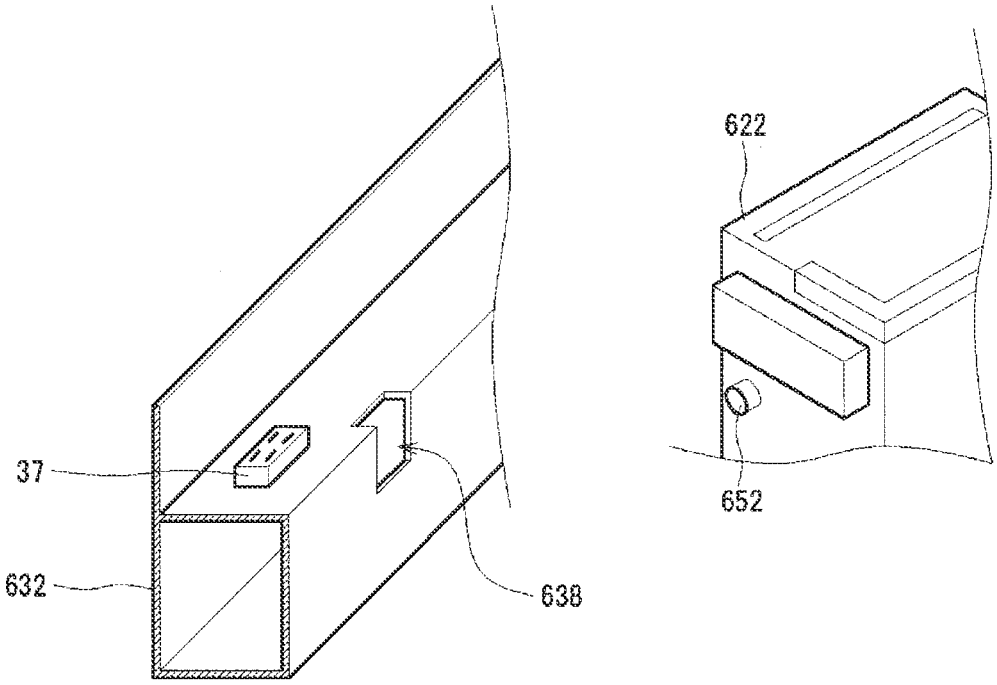
FIG. 27B is a schematic diagram illustrating positioning of a storage cassette with respect to a loading section according to another exemplary embodiment.

In the second exemplary embodiment described above, explanation has been given regarding a case in which the positioning projection 138 is provided on the left side face of the right frame 132 (FIG. 18A to FIG. 18C), and the guide groove 148 is provided on the left side face of the storage cassette 122 (FIG. 19 and FIG. 20A to FIG. 20E). However, the present disclosure is not limited thereto. For example, as illustrated in FIG. 27B, a guide groove 638 may be formed on a left side face of a right frame 632, and a positioning projection 652 may be formed on a right side face of a storage cassette 622. Similar applies to the positioning projections 39 and 140 and the guide groove 47, and similar also applies to the first exemplary embodiment.

Figure 28A:
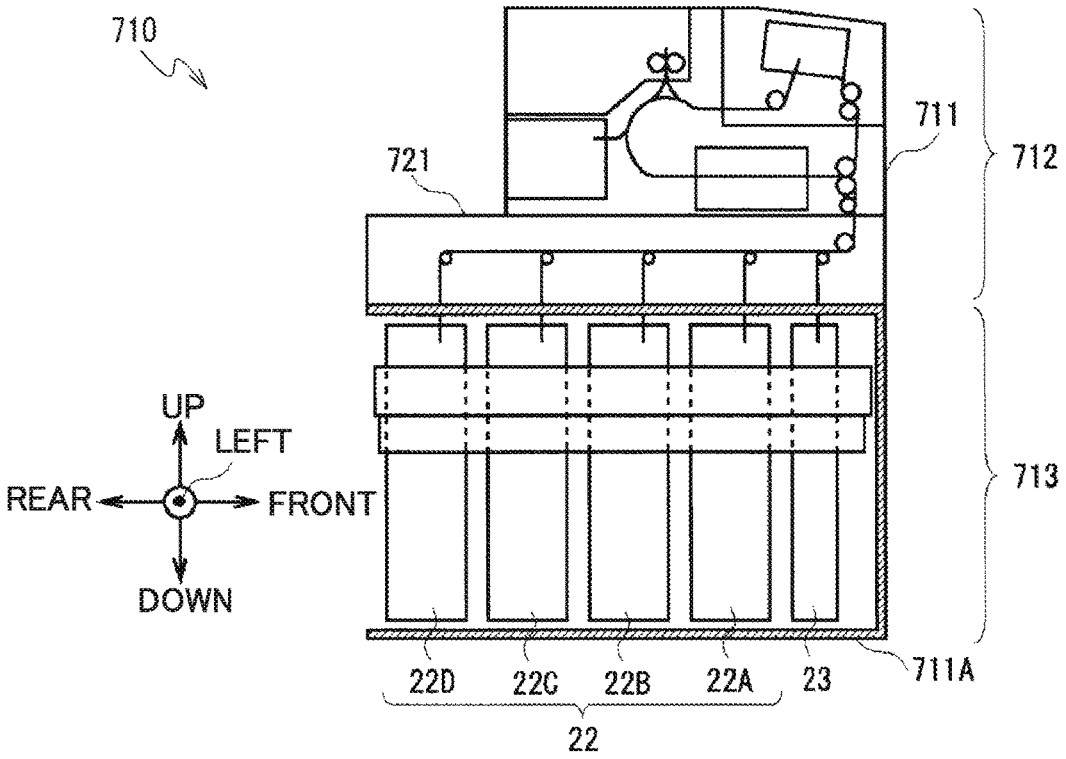
FIG. 28A is a schematic diagram to illustrate pulling out of a lower section unit, according to another exemplary embodiment.
Figure 28B:
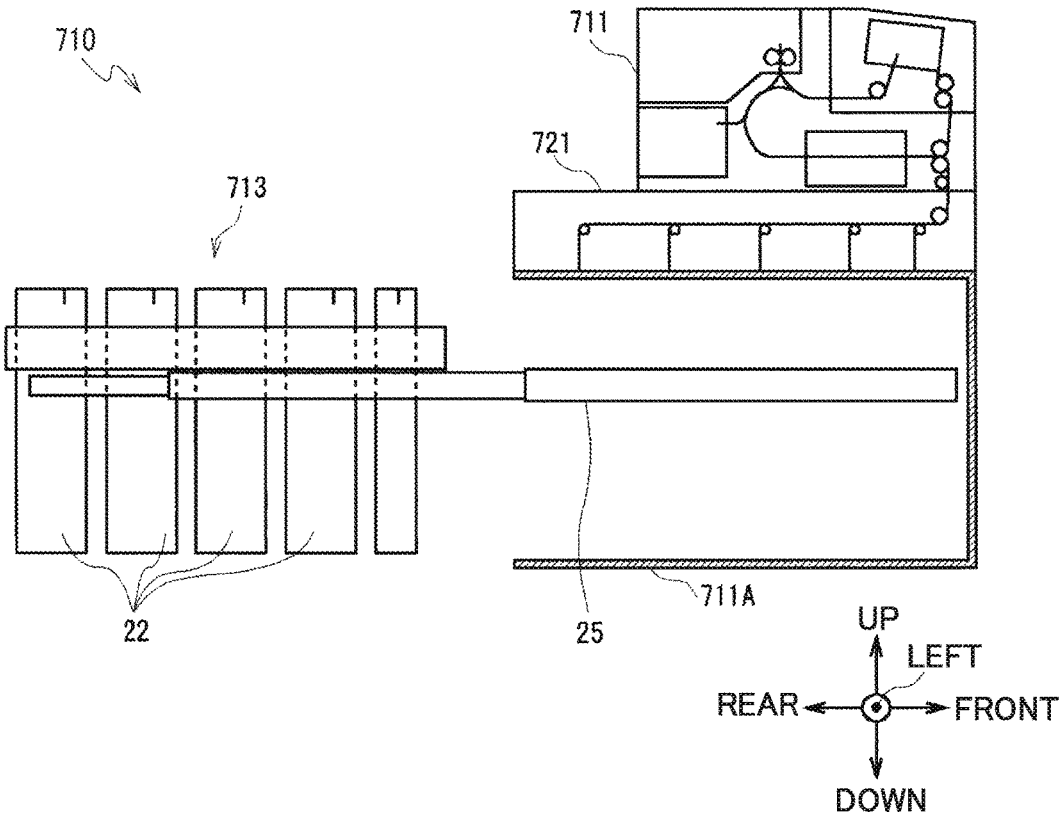
FIG. 28B is a schematic diagram to illustrate pulling out of a lower section unit, according to another exemplary embodiment.
Figure 29:
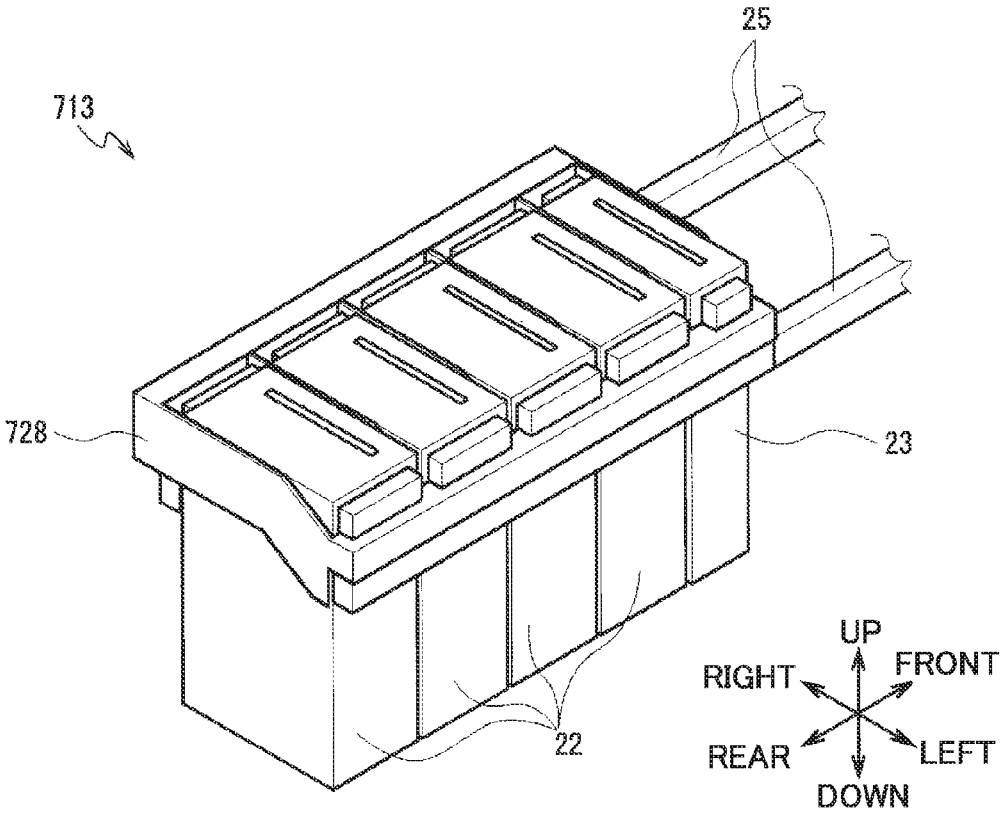
FIG. 29 is a schematic diagram illustrating configuration of a loading section according to another exemplary embodiment.

In the first exemplary embodiment described above, explanation has been given regarding a case in which the lower conveyance section 21 is provided inside the lid body 27 at the lower section unit 13 side, and the slide rails 25 allow the lower conveyance section 21 to slide in the front-rear direction together with the loading section 28 (FIG. 3, FIG. 4). However, the present disclosure is not limited thereto. For example, as in a banknote pay-in/pay-out device 710 illustrated in FIG. 28A and FIG. 28B, which correspond to FIG. 2 and FIG. 3, a lower conveyance section 721 may be disposed at an upper section unit 712 side of, and more specifically directly above, a lower section casing 711A, with the lower conveyance section 721 remaining in place while a lower section unit 713 is allowed to slide in the front-rear direction. As illustrated in FIG. 29, which corresponds to FIG. 5, in such cases, the lower section unit 713 may be configured with the lid body 27 and the hinges 29 of the first exemplary embodiment omitted from the lower section unit 13. Similar also applies to the second exemplary embodiment.

In the first exemplary embodiment described above, explanation has been given regarding a case in which the present disclosure is applied to the banknote pay-in/pay-out device 10 of the an ATM 1 that performs cash transactions with a customer. However, the present disclosure is not limited thereto. For example, the present disclosure may be applied to various devices in which storage cassettes are installed and removed in a state in which a loading section has been pulled out from a device body using slide rails, such as in a banknote processing device disposed at a service counter of a financial institution primarily used by a staff member of the financial institution (known as a teller machine). Similar also applies to the second exemplary embodiment.

In the first exemplary embodiment described above, explanation has been given regarding a case in which banknotes serving as a medium are stored in the storage cassettes 22 that are loaded into the loading section 28. However, the present disclosure is not limited thereto, and for example, may be applied to various devices in which storage cassettes store various media such as cash vouchers, securities, entrance tickets, or the like, and the storage cassettes are loaded into and taken out from a loading section. The shape of the medium is not limited to paper sheet shapes such as that of banknotes, and may be various shapes such as rectangular block shapes or spherical shapes. Similar also applies to the second exemplary embodiment.

Moreover, the present disclosure is not limited to each of the exemplary embodiments described above, nor to the other exemplary embodiments described above. Namely, the present disclosure encompasses application to exemplary embodiments combining some or all of the respective exemplary embodiments described above and the other exemplary embodiment described above, and exemplary embodiments having parts derived therefrom.

Moreover, in the first exemplary embodiment described above, explanation has been given regarding a case in which the banknote pay-in/pay-out device 10, serving as a medium processing device, is configured by the storage cassettes 22 serving as storage cassettes, the lower section casing 11A serving as a casing, the loading section 28 serving as a loading section, the slide rails 25 serving as slide rails, the loading section side connector 37 serving as a connector, and the right protective plate 34, the protective bodies 36, and the partitioning plates 33 serving as a protective portion. However, the present disclosure is not limited thereto. A medium processing device may be configured by a storage cassette, a casing, a loading section, slide rails, a connector, and a protective portion of various other configurations.

In the first exemplary embodiment described above, explanation has been given regarding a case in which the ATM 1, serving as a medium transaction device, is configured by the storage cassettes 22 serving as storage cassettes, the lower section casing 11A serving as a casing, the loading section 28 serving as a loading section, the slide rails 25 serving as slide rails, the loading section side connector 37 serving as a connector, and the right protective plate 34, the protective bodies 36, and the partitioning plates 33 serving as a protective portion. However, the present disclosure is not limited thereto. The medium transaction device may be configured by a storage cassette, a casing, a loading section, slide rails, a connector, and a protective portion of various other configurations.

The disclosure of Japanese Patent Application No. 2014-151797 is incorporated in its entirety be reference herein.

All cited documents, patent applications, and technical standards mentioned in the present specification are incorporated by reference in the present specification to the same extent as if the individual cited document, patent application, or technical standard was specifically and individually indicated to be incorporated by reference.

INDUSTRIAL APPLICABILITY

The present disclosure may be applied, for example, to an ATM that performs cash, including banknote, transactions with a customer.

The invention claimed is:

1. A medium processing device, comprising:
- a storage cassette that internally stores a medium;
- a casing that has an internal space for internally storing the storage cassette;
- a loading section that supports the storage cassette in a state of being loaded into a loading hole opened in a bottom portion of the loading section;
- a slide rail that is attached to the casing and the loading section, and that allows the loading section to move between an interior and an exterior of the internal space;
- a connector that electrically connects the loading section and the storage cassette together in a state in which the storage cassette has been loaded into the loading hole and is supported by the loading section;
- a loading section side positioning body that is provided at the loading section;
- a cassette side positioning body that is provided at the storage cassette, and that, in a case in which the storage cassette is loaded into the loading hole, engages with the loading section side positioning body to position the storage cassette with respect to the loading hole;
- a second loading section side positioning body provided projecting out from the loading section toward the loading hole; and
- a second cassette side positioning body that engages with the second loading section side positioning body to position the storage cassette with respect to the positioning hole in a case in which the storage cassette is loaded into the positioning hole.

2. The medium processing device of claim 1, wherein the loading section side positioning body protrudes out further than the connector in an opposite direction opposite to a loading direction in which the storage cassette is loaded into the loading hole.

3. The medium processing device of claim 1, further comprising:
- an insertion hole that is provided at the storage cassette and that allows insertion of the medium from an exterior of the storage cassette,
- wherein the cassette side positioning body and the second cassette side positioning body are disposed on opposite sides of the insertion hole from each other.

4. The medium processing device of claim 1, wherein:

the second loading section side positioning body is provided at the loading section on an opposite side of the loading hole from the loading section side positioning body; and the second cassette side positioning body is provided at the storage cassette on an opposite side of a center of the storage cassette from the cassette side positioning body, and, in a case in which the storage cassette is loaded into the loading hole, engages with the loading section side positioning body to position the storage cassette with respect to the loading hole.

5. A medium transaction device, comprising:

a storage cassette that internally stores a medium to be transacted with a user, or a medium that has been transacted with a user;

a casing that has an internal space for internally storing the storage cassette;

a loading section that supports the storage cassette in a state of being loaded into a loading hole opened in a bottom portion of the loading section;

a slide rail that is attached to the casing and the loading section, and that allows the loading section to move between an interior and an exterior of the internal space;

a connector that electrically connects the loading section and the storage cassette together in a state in which the storage cassette has been loaded into the loading hole and is supported by the loading section;

a loading section side positioning body that is provided at the loading section;

a cassette side positioning body that is provided at the storage cassette, and that, in a case in which the storage cassette is loaded into the loading hole, engages with the loading section side positioning body to position the storage cassette with respect to the loading hole;

a second loading section side positioning body provided projecting out from the loading section toward the loading hole; and a second cassette side positioning body that engages with the second loading section side positioning body to position the storage cassette with respect to the positioning hole in a case in which the storage cassette is loaded into the positioning hole.

6. A medium transaction device, comprising:

a storage cassette that internally stores a medium to be transacted with a user, or a medium that has been transacted with a user;

a casing that has an internal space for internally storing the storage cassette;

a loading section that supports the storage cassette in a state of being loaded into a loading hole opened in a bottom portion of the loading section;

a slide rail that is attached to the casing and the loading section, and that allows the loading section to move between an interior and an exterior of the internal space;

a connector that electrically connects the loading section and the storage cassette together in a state in which the storage cassette has been loaded into the loading hole and is supported by the loading section, the connector being provided outside of a pass-through region through which the storage cassette passes in a case of loading the storage cassette into the loading hole of the loading section;

a loading section side positioning body that is provided at the loading section;

a cassette side positioning body that is provided at the storage cassette, and that, in a case in which the storage cassette is loaded into the loading hole, engages with the loading section side positioning body to position the storage cassette with respect to the loading hole; and a protective portion that is provided at the loading section, and that is formed protruding out further than the connector in an opposite direction opposite to a loading direction in which the storage cassette is loaded into the loading hole.

7. The medium transaction device of claim 6, wherein a protrusion amount of the loading section toward the opposite direction is smaller on at least one side face at a periphery of the loading hole than on another side face at the periphery of the loading hole.

8. The medium transaction device of claim 6, wherein the protective portion is disposed on a second intersecting direction side of the connector, the second intersecting direction intersecting the loading direction and also intersecting a first intersecting direction from the pass-through region toward the connector.

9. The medium transaction device of claim 6, wherein a side face on a pass-through region side of the protective portion forms a face that is continuous with the loading section at least at a connection portion with the loading section.

10. The medium transaction device of claim 6, wherein the protective portion is part of a plurality of partitioning plates that are adjacent to each other and that partition across the pass-through region.

11. The medium transaction device of claim 6, wherein:

the loading section further includes a frame that supports the storage cassette that has been loaded into the loading hole; and the storage cassette further includes a protruding portion that protrudes outside the pass-through region, and that is supported by the frame in a case in which the storage cassette has been loaded into the loading hole.

12. The medium transaction device of claim 11, wherein the frame is formed in a hollow column shape that runs along an intersecting direction intersecting the loading direction.

13. The medium transaction device of claim 6, wherein the loading section further includes a first frame and a second frame, the first and second frames supporting the storage cassette that has been loaded into the loading hole, the first frame including a protective plate that has a portion protruding upward, wherein a protrusion amount of the first frame including the protective plate is larger than the second frame.

* * * * *